US012405024B2

(12) United States Patent
Hjortland et al.

(10) Patent No.: US 12,405,024 B2
(45) Date of Patent: Sep. 2, 2025

(54) HEAT PUMP CONTROL SYSTEMS AND METHODS

(71) Applicant: Johnson Controls Tyco IP Holdings LLP, Milwaukee, WI (US)

(72) Inventors: Andrew Leroy Hjortland, Stoughton, WI (US); Roy Randall Crawford, Blanchard, OK (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 144 days.

(21) Appl. No.: 18/101,988

(22) Filed: Jan. 26, 2023

(65) Prior Publication Data

US 2023/0243544 A1 Aug. 3, 2023

Related U.S. Application Data

(60) Provisional application No. 63/304,415, filed on Jan. 28, 2022.

(51) Int. Cl.
*F24F 11/84* (2018.01)
*F24F 1/08* (2011.01)

(52) U.S. Cl.
CPC ..... *F24F 11/84* (2018.01); *F24F 1/08* (2013.01)

(58) Field of Classification Search
CPC .... F24F 1/08; F24F 11/86; F24F 11/84; F25B 2313/0315; F25B 2400/075; F25B 2600/0251; F25B 2600/0253; F25B 2700/1931; F25B 2700/1933; F25B 2700/2106; F25B 2700/21163; F25B 13/00; F25B 49/022
See application file for complete search history.

(56) References Cited

U.S. PATENT DOCUMENTS

2004/0134206 A1 7/2004 Lee et al.
2006/0218947 A1 10/2006 Lifson et al.
(Continued)

FOREIGN PATENT DOCUMENTS

CN 1735779 A * 2/2006 ..... F25B 13/00
CN 104613615 A * 5/2015
(Continued)

OTHER PUBLICATIONS

International Search Report and Written Opinion for PCT Application No. PCT/US2023/011758, mailed May 22, 2023, 11 pages.

*Primary Examiner* — Kun Kai Ma
(74) *Attorney, Agent, or Firm* — Fletcher Yoder, PC

(57) ABSTRACT

A heat pump for a heating, ventilation, and air conditioning (HVAC) system includes a compressor system configured to direct a refrigerant flow along a refrigerant circuit of the heat pump. The compressor system includes a first compressor and a second compressor arranged in parallel with one another relative to a direction of the refrigerant flow through the compressor system, the first compressor includes a first volume index, and the second compressor includes a second volume index different from the first volume index. The heat pump also includes a controller communicatively coupled to the first compressor and the second compressor and configured to selectively operate the first compressor, the second compressor, or both based on an operating mode the heat pump.

20 Claims, 15 Drawing Sheets

(56) References Cited

U.S. PATENT DOCUMENTS

| | | | |
|---|---|---|---|
| 2010/0186433 | A1 | 7/2010 | Galante et al. |
| 2018/0003423 | A1 | 1/2018 | Galante et al. |
| 2021/0033315 | A1 | 2/2021 | Wallet-Laily et al. |

FOREIGN PATENT DOCUMENTS

| | | | | | |
|---|---|---|---|---|---|
| JP | H09145189 | A | * | 6/1997 | |
| KR | 20080076379 | A | | 8/2008 | |
| KR | 100865093 | B1 | * | 10/2008 | |
| WO | WO-2006098165 | A1 | * | 9/2006 | ..... F25B 13/00 |

* cited by examiner

HEAT PUMP CONTROL SYSTEMS AND METHODS

CROSS-REFERENCE TO RELATED APPLICATIONS

This application claims priority from and the benefit of U.S. Provisional Application No. 63/304,415, entitled "HEAT PUMP CONTROL SYSTEMS AND METHODS," filed Jan. 28, 2022, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

A heating, ventilation, and/or air conditioning (HVAC) system may be used to thermally regulate an environment, such as a space within a building, home, or other structure. The HVAC system generally includes a vapor compression system having heat exchangers, such as a condenser and an evaporator, which transfer thermal energy between the HVAC system and the environment. Typically, a compressor is fluidly coupled to a refrigerant circuit of the vapor compression system and is configured to circulate a working fluid (e.g., refrigerant) between the condenser and the evaporator. In this way, the compressor facilitates heat exchange between the refrigerant, the condenser, and the evaporator. In some cases, refrigerant flow through the refrigerant circuit may be reversible, such that the condenser is operable as an evaporator (e.g., a heat absorber), and the evaporator is operable a condenser (e.g., a heat rejector). Accordingly, the HVAC system may operate as a heat pump system in multiple operating modes (e.g., a cooling mode, a heating mode) to provide both heating and cooling to the building with one refrigeration circuit. Unfortunately, conventional compressors may be ill-suited to selectively operate the refrigerant circuit in the cooling mode or the heating mode. Therefore, implementation of such compressors in heat pump systems may reduce an overall operational efficiency of the HVAC system.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to a heat pump for a heating, ventilation, and air conditioning (HVAC) system including a compressor system configured to direct a refrigerant flow along a refrigerant circuit of the heat pump. The compressor system includes a first compressor and a second compressor arranged in parallel with one another relative to a direction of the refrigerant flow through the compressor system, the first compressor includes a first volume index, and the second compressor includes a second volume index different from the first volume index. The heat pump also includes a controller communicatively coupled to the first compressor and the second compressor and configured to selectively operate the first compressor, the second compressor, or both based on an operating mode the heat pump.

The present disclosure also relates to a heat pump for a heating, ventilation, and air conditioning (HVAC) system including a first compressor configured to direct refrigerant flow along a refrigerant circuit of the heat pump, where the first compressor has a first built-in volume ratio, and a second compressor configured to direct refrigerant flow along the refrigerant circuit of the heat pump, where the second compressor has a second built-in volume ratio. The first compressor and the second compressor are arranged in parallel with one another relative to a direction of refrigerant flow through the refrigerant circuit, and the second built-in volume ratio is greater than the first built-in volume ratio. The heat pump also includes a controller communicatively coupled to the first compressor and the second compressor and configured to selectively operate the first compressor, the second compressor, or both based on an operating mode the heat pump, The present disclosure further relates to a heat pump for a heating, ventilation, and air conditioning (HVAC) system including a refrigerant circuit and a compressor system disposed along the refrigerant circuit and configured to direct a refrigerant along the refrigerant circuit, where the compressor system includes a first compressor and a second compressor arranged in parallel with one another relative to a flow direction of the refrigerant through the compressor system, the first compressor includes a first volume index, and the second compressor includes a second volume index greater than the first volume index. The heat pump further includes a first heat exchanger disposed along the refrigerant circuit and configured to place the refrigerant in a heat exchange relationship with a supply air flow, a second heat exchanger disposed along the refrigerant circuit and configured to place the refrigerant in a heat exchange relationship with an ambient air flow, and a reversing valve configured to direct the refrigerant from the compressor system to the second heat exchanger in a cooling mode of the heat pump and configured to direct the refrigerant from the compressor system to the first heat exchanger in a heating mode of the heat pump. The heat pump also includes a controller communicatively coupled to the first compressor and the second compressor and configured to operate the first compressor and suspend operation of the second compressor in the cooling mode.

BRIEF DESCRIPTION OF THE DRAWINGS

Various aspects of this disclosure may be better understood upon reading the following detailed description and upon reference to the drawings in which.

DETAILED DESCRIPTION

Figure 1:
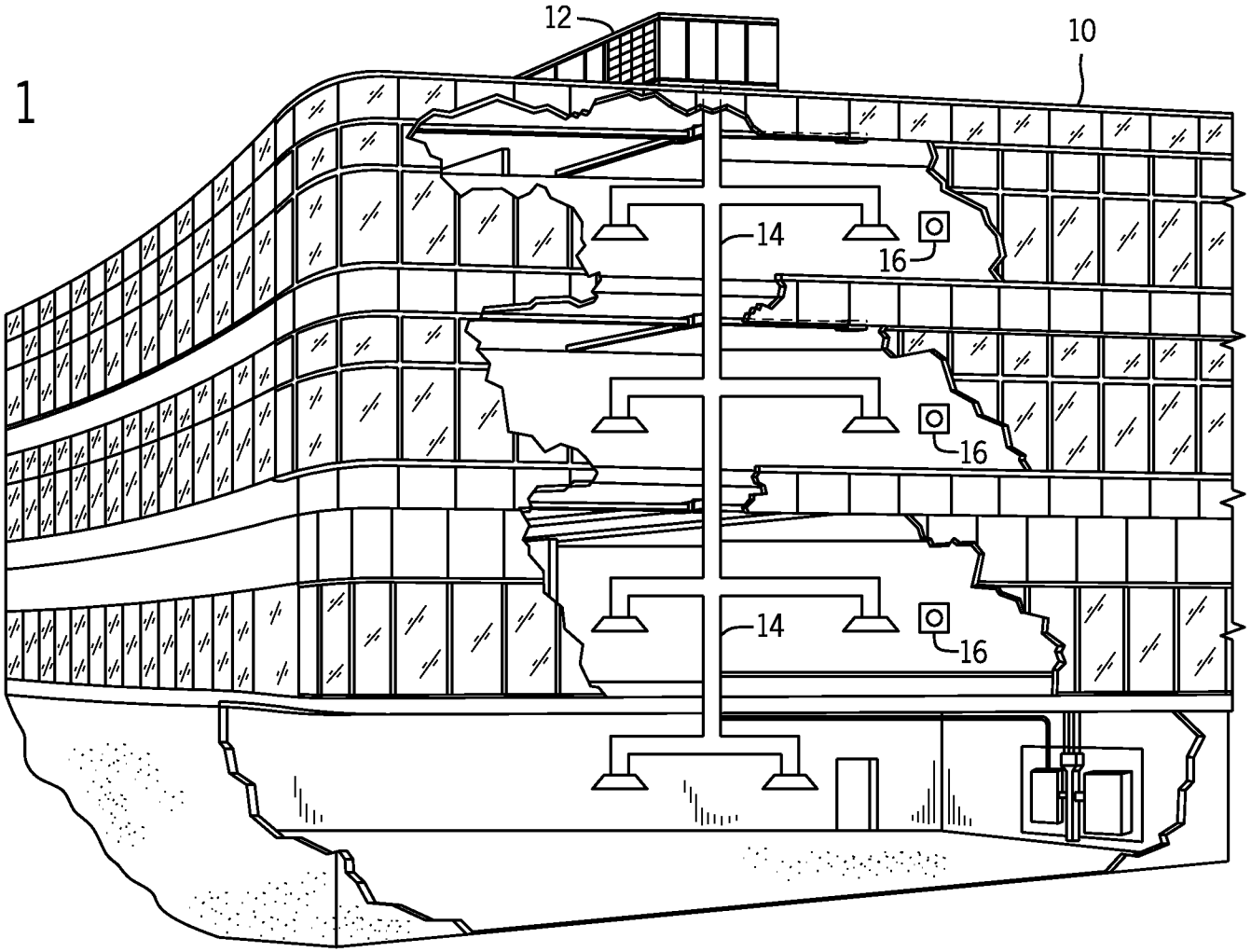
FIG. 1 is a perspective view of an embodiment of a building incorporating a heating, ventilation, and air conditioning (HVAC) system in a commercial setting, in accordance with an aspect of the present disclosure.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "approximately," "generally," and "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to mean that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar," "slope," "perpendicular," "parallel," and so forth are intended to encompass features of surfaces or elements as understood to one of ordinary skill in the relevant art, and should not be rigidly interpreted as might be understood in the mathematical arts. For example, a "planar" surface is intended to encompass a surface that is machined, molded, or otherwise formed to be substantially flat or smooth (within related tolerances) using techniques and tools available to one of ordinary skill in the art. Similarly, a surface having a "slope" is intended to encompass a surface that is machined, molded, or otherwise formed to be oriented at an angle (e.g., incline) with respect to a point of reference using techniques and tools available to one of ordinary skill in the art.

As briefly discussed above, a heating, ventilation, and air conditioning (HVAC) system may be used to thermally regulate a space within a building, home, or other suitable structure. For example, the HVAC system may include a vapor compression system that operates to transfer thermal energy between a working fluid, such as a refrigerant, and a fluid to be conditioned, such as air. The vapor compression system includes heat exchangers, such as a condenser and an evaporator, which are fluidly coupled to one another via one or more conduits of a working fluid loop or circuit. A compressor may be used to circulate the working fluid through the conduits and other components of the working fluid circuit (e.g., an expansion device) and, thus, enable the transfer of thermal energy between components of the working fluid circuit (e.g., between the condenser and the evaporator) and one or more thermal loads (e.g., an environmental air flow, a supply air flow). Additionally or alternatively, the HVAC system may include a heat pump (e.g., a heat pump system, a reverse-cycle heat pump) having a first heat exchanger (e.g., a heating and/or cooling coil, an indoor coil, the evaporator) positioned within or otherwise fluidly coupled to the space to be conditioned, a second heat exchanger (e.g., a heating and/or cooling coil, an outdoor coil, the condenser) positioned in or otherwise fluidly coupled to an ambient environment (e.g., the atmosphere), and a pump (e.g., the compressor) configured to circulate the working fluid (e.g., refrigerant) between the first and second heat exchangers to enable heat transfer between the thermal load and the ambient environment, for example. The heat pump system is operable to provide both cooling or heating to the space to be conditioned (e.g., a room, zone, or other region within a building) by adjusting a flow of the working fluid through the working fluid circuit.

For example, during operation of the heat pump system in a cooling mode, the compressor may direct working fluid through the working fluid circuit and the first and second heat exchangers in a first flow direction. While receiving working fluid in the first flow direction, the first heat exchanger (which may be positioned within the space to be conditioned) may operate as an evaporator and, thus, enable working fluid flowing through the first heat exchanger to absorb thermal energy from an air flow directed to the space. Further, the second heat exchanger (which may be positioned in the ambient environment surrounding the heat pump system), may operate as a condenser to reject the heat absorbed by the working fluid flowing from the first heat exchanger (e.g., to an ambient air flow directed across the second heat exchanger). In this way, the heat pump system may facilitate cooling of the space or other thermal load serviced by (e.g., in thermal communication with) the first heat exchanger.

Conversely, during operation in a heating mode, a reversing valve (e.g., a switch-over valve) enables the compressor to direct working fluid through the refrigerant circuit and the first and second heat exchangers in a second flow direction, opposite the first flow direction. While receiving working fluid in the second flow direction, the first heat exchanger may operate as a condenser instead of an evaporator, and the second heat exchanger may operate as an evaporator instead of a condenser. As such, the first heat exchanger may receive (e.g., from the second heat exchanger) a flow of heated working fluid to reject heat to thermal load serviced by the first heat exchanger (e.g., an air flow directed to the space) and, thus, facilitate heating of the thermal load. In this way, the heat pump system may facilitate either heating or cooling of the thermal load based on the selected operational mode of the heat pump system (e.g., based on a flow direction of working fluid along the working fluid circuit).

In many cases, pressure differentials or pressure ratios across various components (e.g., a compressor) or sections of the working fluid circuit (e.g., refrigerant circuit) may vary based on the mode (e.g., cooling operating mode, heating operating mode) in which the heat pump system is operated. As an example, pressure ratios across a compressor of the working fluid circuit may be relatively small while the heat pump system operates in the cooling mode and may be relatively large while the heat pump system operates in the heating mode. In particular, such pressure ratios may be indicative of a differential between an entering working fluid pressure at an inlet of the compressor and an exiting working fluid pressure at an outlet of the compressor. Typically, a volume index (e.g., a volume ratio, built-in volume ratio) of the compressor coupled to the working fluid circuit may be fixed (e.g., invariable), which may cause the compressor to be ill-suited or incapable of adjusting working fluid compression and working fluid circulation along the working fluid circuit in response to the varying pressure differentials that may be encountered between operation in the cooling and heating modes of the heat pump system. As a result, throughout a duration in which the heat pump system operates in either the cooling mode, the heating mode, or both, conventional compressors may limit an overall operational efficiency of the HVAC system.

Accordingly, embodiments of the present disclosure relate to a heat pump system having a compressor system configured to adjust compression and/or circulation of working fluid (e.g., refrigerant) along the working fluid circuit based on one or more operational parameters, modes, and/or characteristics of the heat pump system to improve efficiency of the heat pump system. Such operational parameters may include an operational mode (e.g., cooling, heating) of the heat pump system, a load or demand of one or more thermal loads serviced by the heat pump system, and/or ambient (e.g., atmospheric) conditions surrounding the heat pump system. In any case, implementation of the disclosed heat pump system may improve the overall operational efficiency of the HVAC system during cooling and heating operations.

For example, the compressor system disclosed herein may include a first compressor and a second compressor that are fluidly coupled to the working fluid circuit (e.g., in a parallel configuration). The first compressor (e.g., one or more compressors) may include operational characteristics (e.g., a volume index, built-in volume ratio, compression ratio, a capacity, a power output) that facilitate enhanced operation of the heat pump system in the cooling mode, while the second compressor (e.g., one or more compressors) may include operational characteristics that facilitate enhanced operation of the heat pump system in the heating mode. As an example, the first compressor configured to enable more efficient operation of the heat pump system in the cooling mode may have a first built-in volume ratio (BVR) or volume index (e.g., fixed volume index) that is lower than a second BVR or volume index of the second compressor configured to enable more efficient operation of the heat pump system in the heating mode.

In some embodiments, respective characteristics of the first and second compressors may be selected for a particular heat pump system based on an expected duration of different ambient temperatures across a particular time period (e.g., a season, a year). In other words, respective characteristics of the first and second compressors may be selected based on a particular climate (e.g., warm, temperate, cold) or geographic region in which the heat pump is to be utilized. For example, in a warmer climate, the first compressor may have a larger displacement than the second compressor, in a temperate climate the first compressor and the second compressor may have similar displacements, and in a colder climate, the second compressor may have a larger displacement than the first compressor. A controller of the heat pump system may be configured to selectively operate the first compressor, the second compressor, both the first compressor and the second compressor, and/or one or more additional compressors of the compressor system based on the operational parameters of the heat pump system and the operational characteristics of the compressors in a manner that enhances the overall operational efficiency of the heat pump system.

As an example, upon receiving a call (e.g., a control instruction) to operate the heat pump system in the cooling mode, the controller may activate the first compressor while retaining remaining compressors of the compressor system (e.g., the second compressor) in an idle (e.g., inactive) state. Conversely, upon receiving a call to operate the heat pump system in the heating mode, the controller may activate the second compressor while retaining remaining compressors of the compressor system (e.g., the first compressor) in the idle state. In this way, the controller may operate particular compressors of the compressor system that enable an improved relative operational efficiency of the heat pump system based on the current operating conditions experienced by the heat pump system (e.g., based on the current operating mode of the heat pump system).

As discussed in detail below, the controller may selectively operate individual compressors or combinations of compressors included in the compressor system in accordance with the presently disclosed techniques. Moreover, it should be understood that one or more of the compressors included in the compressor system may be fixed speed compressors, multi-stage (e.g., two stage) compressors, and/or variable speed compressors. These and other features will be described below with reference to the drawings.

Turning now to the drawings, FIG. 1 illustrates an embodiment of a heating, ventilation, and air conditioning (HVAC) system for environmental management that employs one or more HVAC units in accordance with the present disclosure. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12 with a reheat system in accordance with present embodiments. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air-cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more working fluid circuits (e.g., refrigeration circuits) for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
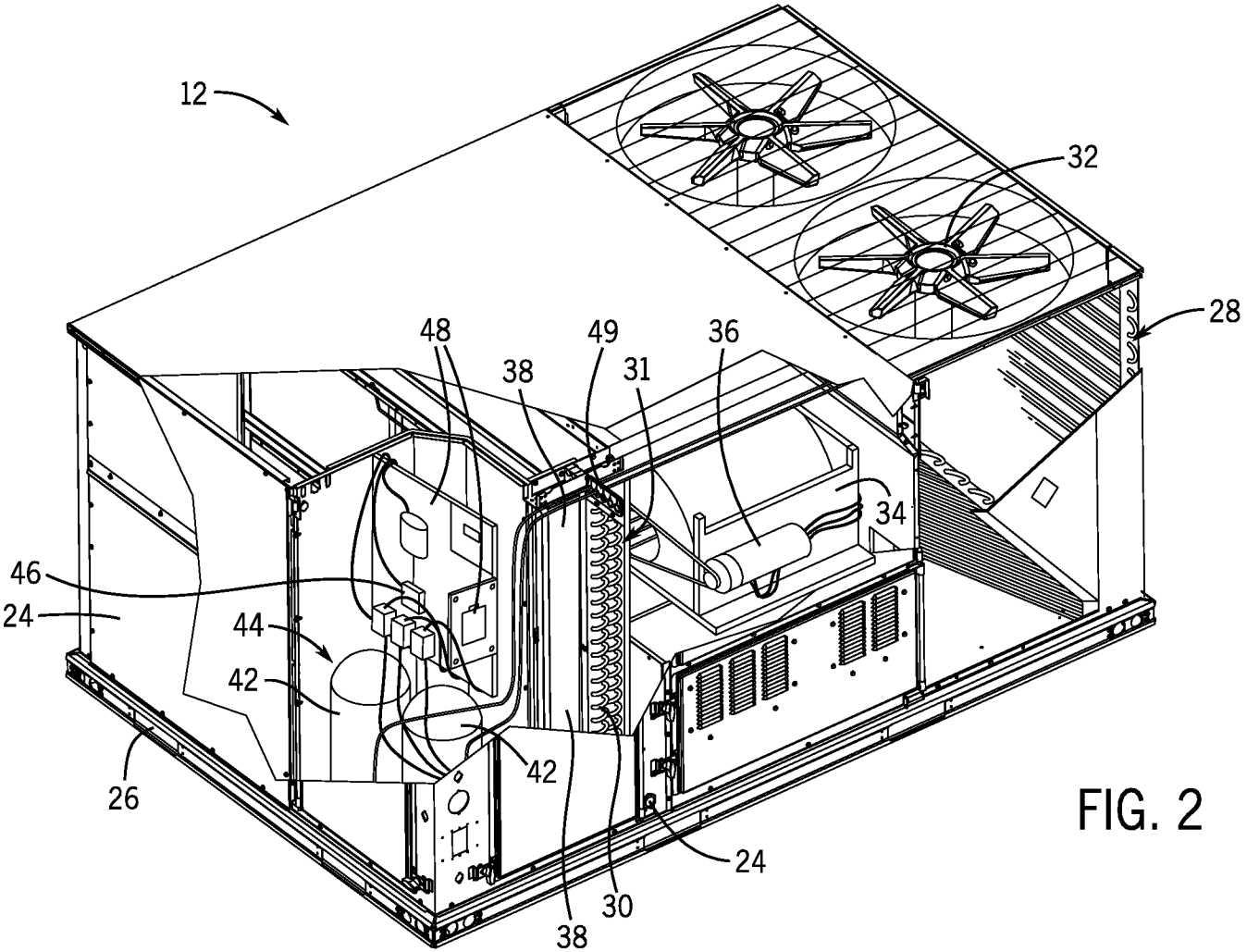
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits (e.g., working fluid circuits). Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
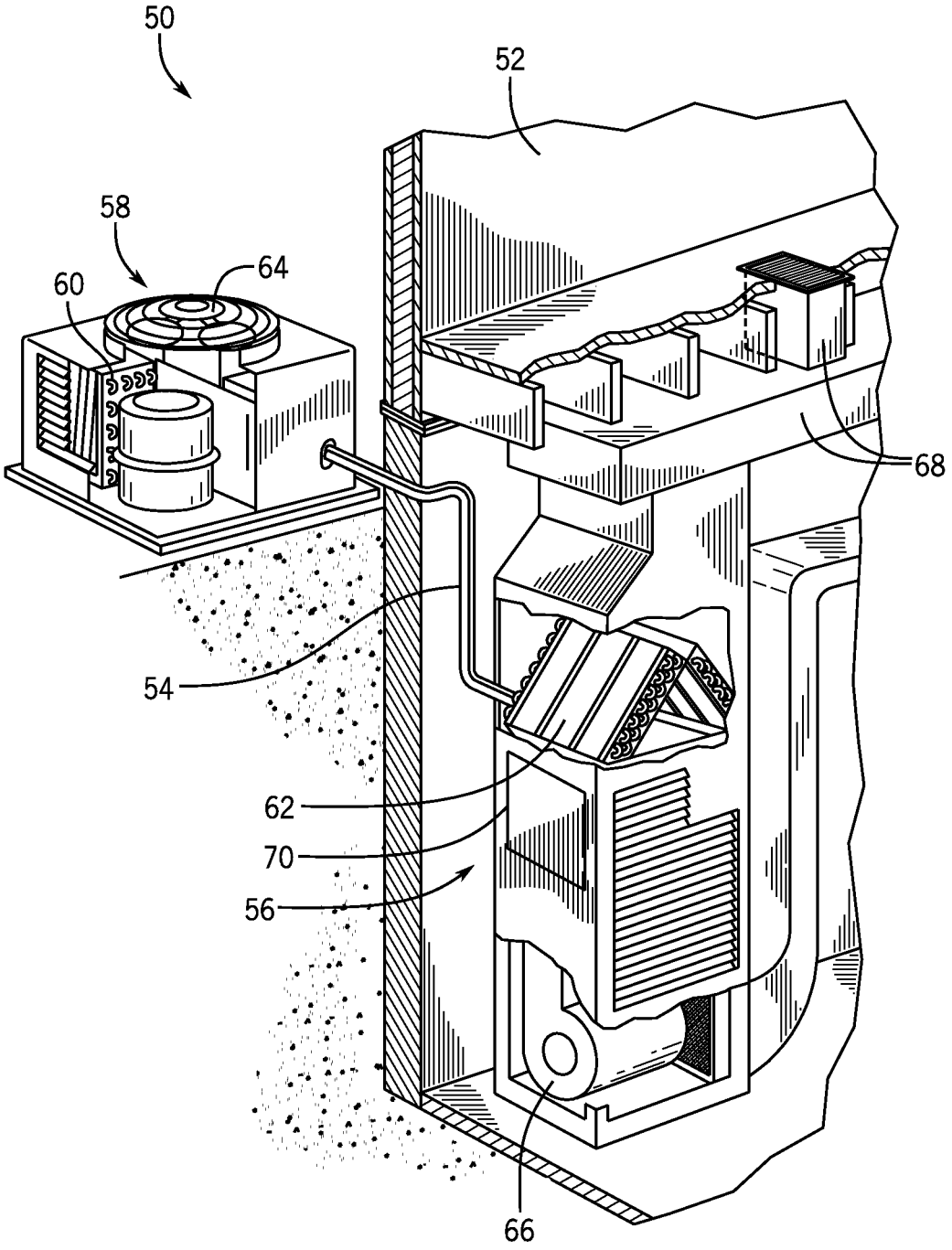
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 (e.g., working fluid conduits) that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily. The outdoor unit 58 may include a reheat system in accordance with present embodiments.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
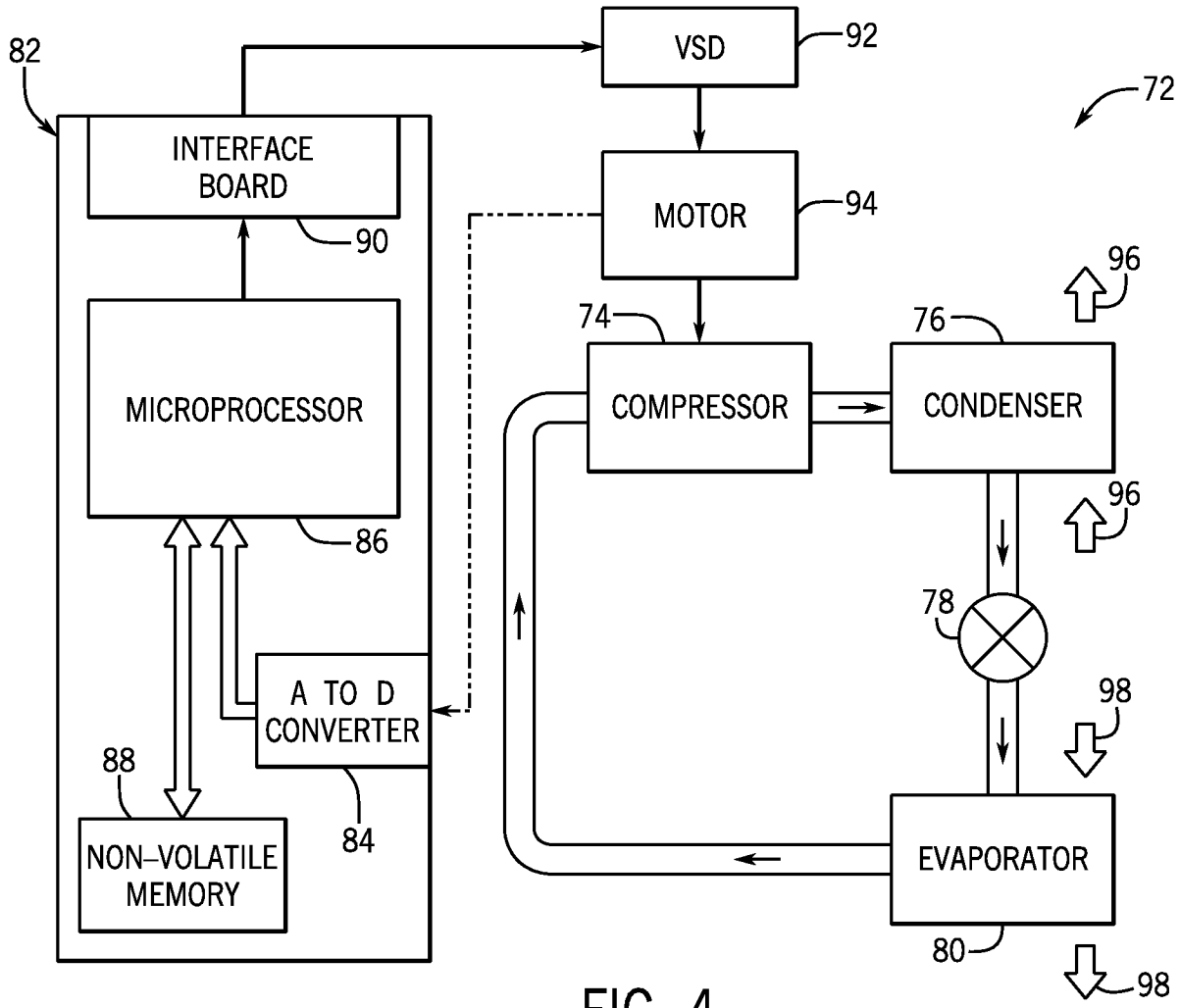
FIG. 4 is a schematic diagram of an embodiment of a vapor compression system used in an HVAC system, in accordance with an aspect of the present disclosure.

FIG. 4 is an embodiment of a vapor compression system 72 that can be used in any of the systems described above. The vapor compression system 72 may circulate a working fluid (e.g., refrigerant) through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil. In the illustrated embodiment, the reheat coil is represented as part of the evaporator 80. The reheat coil is positioned downstream of the evaporator heat exchanger relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
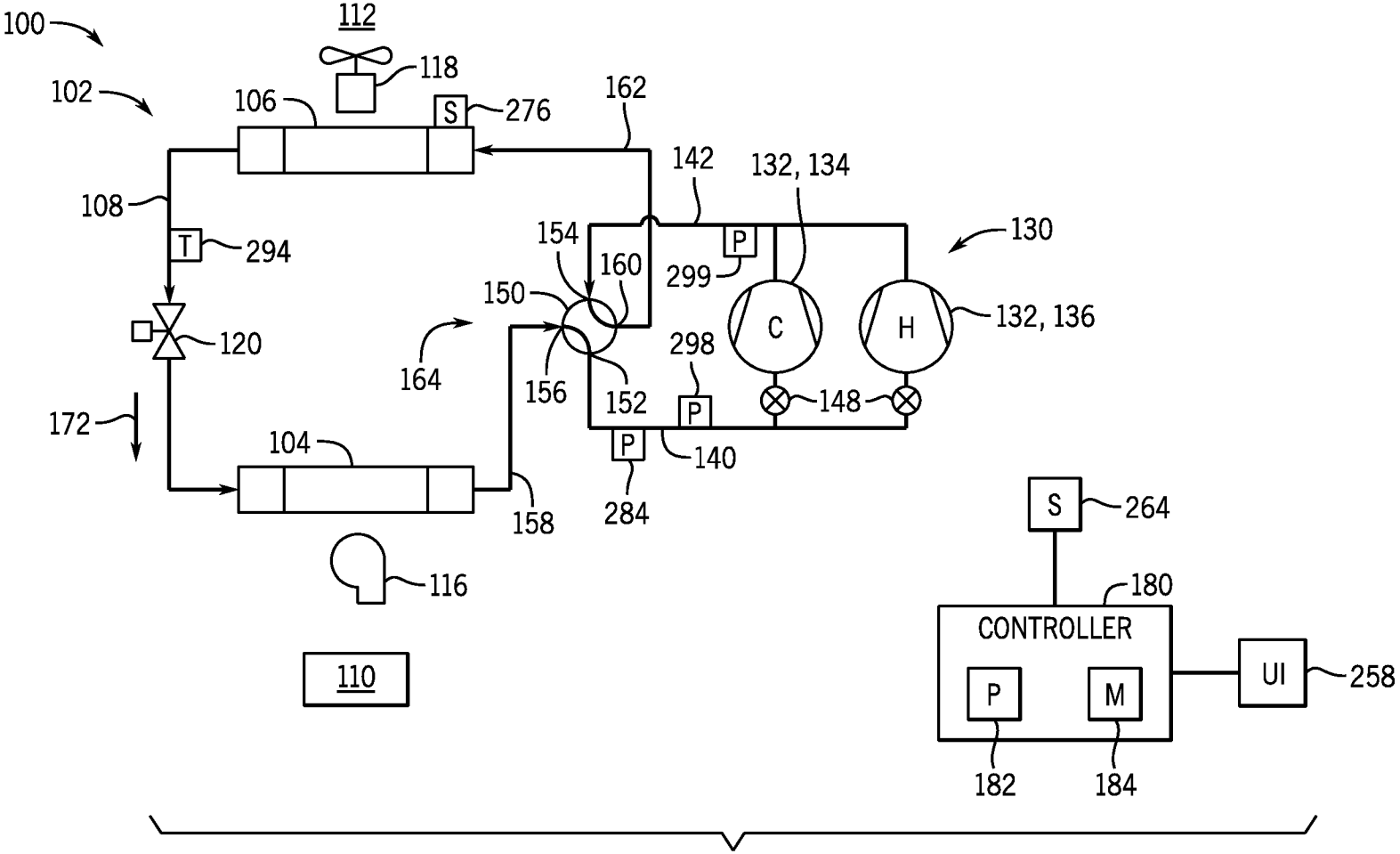
FIG. 5 is a schematic diagram of an embodiment of a portion of an HVAC system that includes a heat pump system, illustrating the heat pump system configured for operation in a cooling mode, in accordance with an aspect of the present disclosure.

As briefly discussed above, embodiments of the present disclosure are directed to an HVAC system having an improved heat pump system. To provide context for the following discussion, FIG. 5 is a schematic of an embodiment of a portion of an HVAC system 100 that includes a heat pump 102 (e.g., a heat pump system, reverse-cycle heat pump) in accordance with present embodiments. The heat pump 102 may include a portion of or all of the components of the vapor compression system 72 discussed above. The heat pump 102 includes a first heat exchanger 104 and a second heat exchanger 106 that are fluidly coupled to one another via a refrigerant circuit 108 (e.g., one or more conduits, working fluid circuit). The first heat exchanger 104 may be in thermal communication with (e.g., fluidly coupled to) a thermal load 110 (e.g., a room, space, and/or device) serviced by the heat pump 102, and the second heat exchanger 106 may be in thermal communication with an ambient environment 112 (e.g., the atmosphere) surrounding the HVAC system 100.

In some embodiments, a first fan 116 may direct a first air flow across the first heat exchanger 104 to facilitate heat exchange between refrigerant within the first heat exchanger 104 and the thermal load 110, while a second fan 118 may direct a second air flow across the second heat exchanger 106 to facilitate heat exchange between refrigerant within the second heat exchanger 106 and the ambient environment. An expansion device 120 (e.g., an electronic expansion valve) may be disposed along the refrigerant circuit 108 between the first heat exchanger 104 and the second heat exchanger 106 and may be configured to regulate (e.g., throttle) a refrigerant flow and/or a refrigerant pressure differential between the first and second heat exchangers 104, 106.

The heat pump 102 also includes a compressor system 130 disposed along the refrigerant circuit 108. The compressor system 130 includes a plurality of compressors 132, such as a first compressor 134 and a second compressor 136, which, as discussed below, are each configured to direct refrigerant flow through the first heat exchanger 104, the second heat exchanger 106, and remaining components (e.g., the expansion device 120) that may be fluidly coupled to the refrigerant circuit 108. Although the compressor system 130 is shown as having two compressors 132 in the illustrated embodiment, the compressor system 130 may include any suitable quantity of compressors 132, such as two, three, four, five, six, or more than six compressors 132. In any case, at least a subset of the compressors 132 may be fluidly coupled to one another in a parallel configuration or a parallel arrangement (e.g., relative to a flow of refrigerant through the compressors 132). For example, the compressor system 130 may include a suction conduit 140 and a discharge conduit 142, and the first and second compressors 134, 136 may be fluidly coupled to the suction conduit 140 and the discharge conduit 142 in a parallel flow configuration with respect to one another. In this way, the first compressor 134 and the second compressor 136 may each be operable to draw (e.g., intake) a refrigerant flow from the suction conduit 140 and discharge (e.g., output) the refrigerant flow through the discharge conduit 142. The compressor system 130 may include one or more valves 148 (e.g., check valves, solenoid valve, modulating valves) that are operable to enable the first compressor 134, the second compressor 136, both the first and second compressors 134, 136, and/or additional compressors 132 to direct refrigerant through the refrigerant circuit 108. In particular, the one or more valves 148 may be controlled (e.g., adjusted) to adjust refrigerant flow through one or more of the compressors 132.

The compressor system 130 may be fluidly coupled to a remainder of the refrigerant circuit 108 via a reversing valve 150 (e.g., a switch-over valve). In particular, the reversing valve 150 may include a first port 152 that is fluidly coupled to the suction conduit 140, a second port 154 that is fluidly coupled to the discharge conduit 142, a third port 156 that is fluidly coupled to a first conduit portion 158 of the refrigerant circuit 108 extending to the first heat exchanger 104, and a fourth port 160 that is fluidly coupled to a second conduit portion 162 of the refrigerant circuit 108 extending to the second heat exchanger 106.

Figure 6:
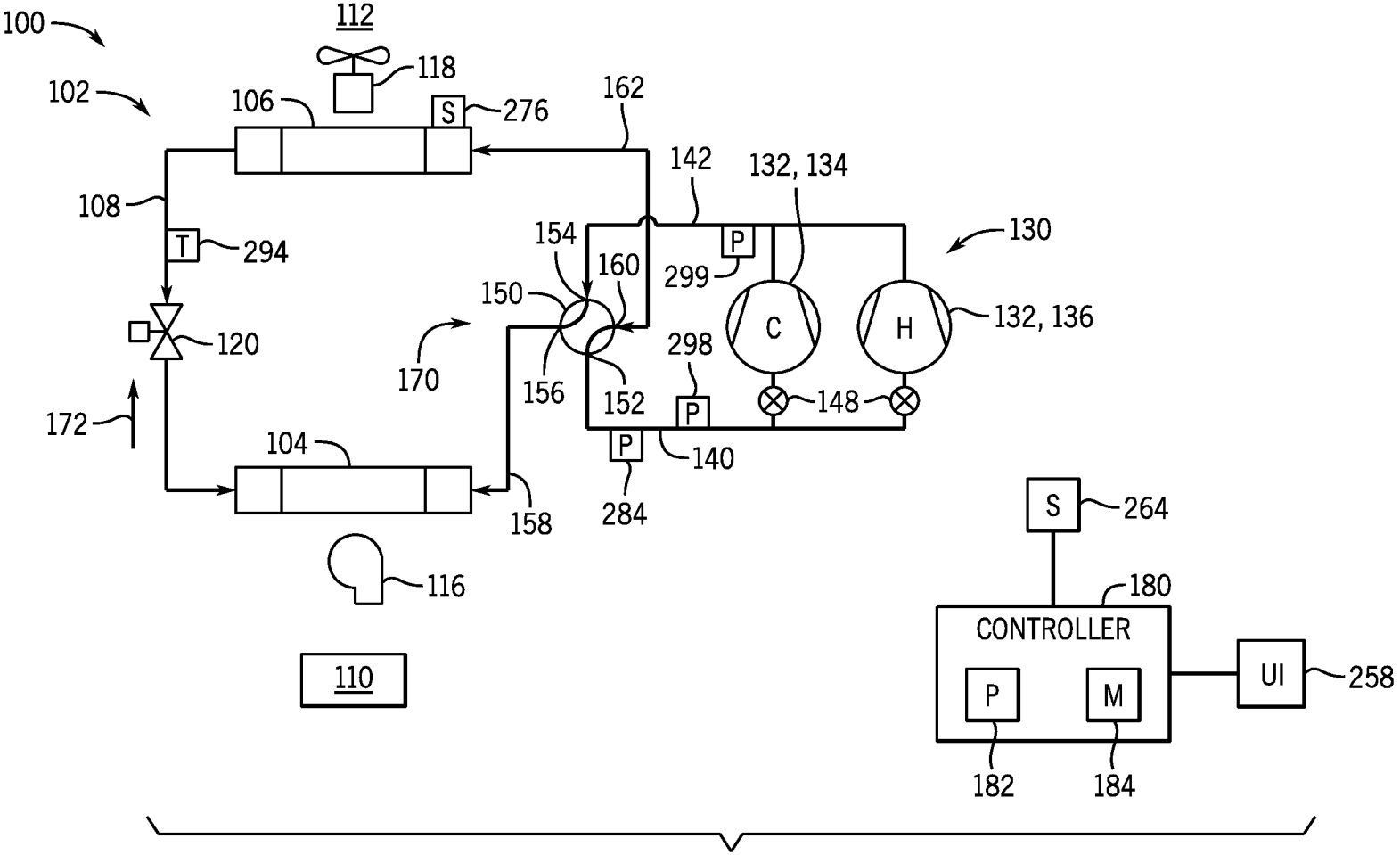
FIG. 6 is a schematic diagram of an embodiment of a portion of an HVAC system that includes a heat pump system, illustrating the heat pump system configured for operation in a heating mode, in accordance with an aspect of the present disclosure.

The reversing valve 150 is configured to transition between a first configuration 164, in which the reversing valve 150 fluidly couples the first port 152 and the third port 156 and fluidly couples the second port 154 and the fourth port 160, and a second configuration 170, illustrated in FIG. 6, in which the reversing valve 150 fluidly couples the first port 152 and the fourth port 160 and fluidly couples the second port 154 and the third port 156. Accordingly, in the first configuration 164, the reversing valve 150 enables the compressors 132 to receive a flow of refrigerant from the first heat exchanger 104 and to discharge a flow of refrigerant to the second heat exchanger 106. Conversely, in the second configuration 170, the reversing valve 150 enables the compressors 132 to receive a flow of refrigerant from the second heat exchanger 106 and to discharge a flow of refrigerant to the first heat exchanger 104. In this way, while in the first configuration 164, the reversing valve 150 enables the heat pump 102 to operate in a cooling mode, in which the first heat exchanger 104 absorbs thermal energy from the thermal load 110 to cool the thermal load 110, and the second heat exchanger 106 rejects the absorbed thermal energy (e.g., absorbed from the thermal load 110) to the ambient environment 112. Further, while in the second configuration 170, the reversing valve 150 enables the heat pump 102 to operate in a heating mode, in which the second heat exchanger 106 absorbs thermal energy from the ambient environment 112, and the first heat exchanger 104 rejects the absorbed thermal energy (e.g., absorbed from the ambient environment 112) to the thermal load 110 to heat the thermal load 110. As such, while the reversing valve 150 is in the first configuration 164, the compressor system 130 may direct a refrigerant flow along at least a portion of the refrigerant circuit 108 in a first flow direction 172. While the reversing valve 150 is in the second configuration 170, the compressor system 130 may direct a refrigerant flow along at least a portion of the refrigerant circuit 108 in a second flow direction 174, opposite the first flow direction 172. For clarity, the heat pump 102 is shown configured for operation in a cooling mode in the illustrated embodiment of FIG. 5. Moreover, FIG. 6 is a schematic of an embodiment of a portion of the HVAC system 100, illustrating the heat pump 102 configured for operation in a heating mode.

The present discussion continues with reference to FIG. 5. The HVAC system 100 may include a controller 180 (e.g., a control system, a thermostat, a control panel) that is communicatively coupled to one or more components of the heat pump 102 and is configured to monitor, adjust, and/or otherwise control operation of the components of the heat pump 102. For example, one or more control transfer devices, such as wires, cables, wireless communication devices, and the like, may communicatively couple the compressors 132, the reversing valve 150, the expansion device 120, the first and/or second fans 116, 118, the control device 16 (e.g., a thermostat), and/or any other suitable components of the HVAC system 100 to the controller 180. That is, the compressors 132, the reversing valve 150, the expansion device 120, the first and/or second fans 116, 118, and/or the control device 16 may each have a communication component that facilitates wired or wireless (e.g., via a network) communication with the controller 180. In some embodiments, the communication components may include a network interface that enables the components of the HVAC system 100 to communicate via various protocols such as EtherNet/IP, ControlNet, DeviceNet, or any other communication network protocol. Alternatively, the communication component may enable the components of the HVAC system 100 to communicate via mobile telecommunications technology, Bluetooth®, near-field communications technology, and the like. As such, the compressors 132, the reversing valve 150, the expansion device 120, the first and/or second fans 116, 118, and/or the control device 16 may wirelessly communicate data between each other.

In some embodiments, the controller 180 may include a portion or all of the control panel 82 illustrated in FIG. 4 or may be another suitable controller included in the HVAC system 100. In any case, the controller 180 may be configured to control components of the HVAC system 100 in accordance with the techniques discussed herein. The controller 180 includes processing circuitry 182 (e.g., one or more processors), such as a microprocessor, which may execute software for controlling the components of the HVAC system 100. The processing circuitry 182 may include multiple microprocessors, one or more "general-purpose" microprocessors, one or more special-purpose microprocessors, and/or one or more application specific integrated circuits (ASICS), or some combination thereof. For example, the processing circuitry 182 may include one or more reduced instruction set (RISC) processors.

The controller 180 may also include a memory device 184 (e.g., a memory) that may store information such as instructions, control software, look up tables, configuration data, etc. The memory device 184 may include a volatile memory, such as random access memory (RAM), and/or a nonvolatile memory, such as read-only memory (ROM). The memory device 184 may store a variety of information and may be used for various purposes. For example, the memory device 184 may store processor-executable instructions including firmware or software for the processing circuitry 182 execute, such as instructions for controlling components of the HVAC system 100. In some embodiments, the memory device 184 is a tangible, non-transitory, machine-readable-medium that may store machine-readable instructions for the processing circuitry 182 to execute. The memory device 184 may include ROM, flash memory, a hard drive, or any other suitable optical, magnetic, or solid-state storage medium, or a combination thereof. The memory device 184 may store data, instructions, and any other suitable data.

Figure 7:
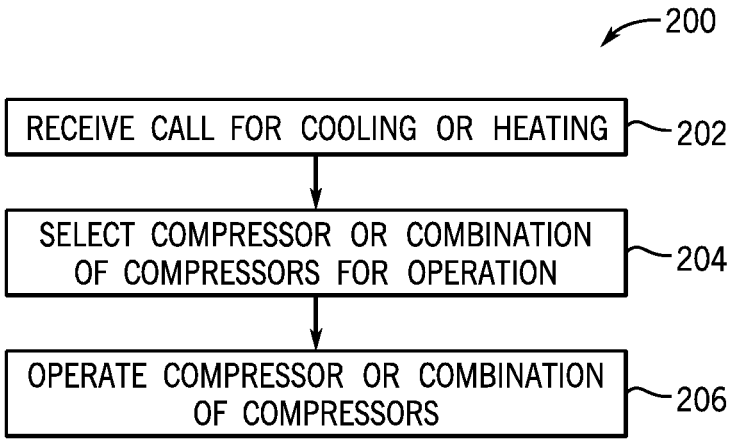
FIG. 7 is a flow diagram of an embodiment of a process for operating a heat pump system, in accordance with an aspect of the present disclosure.

To facilitate the following discussion, FIG. 7 is flow diagram of an embodiment of a process 200 for controlling the heat pump 102 in accordance with the presently disclosed techniques. FIG. 7 will be referred to concurrently with FIGS. 5 and 6 throughout the following discussion. It should be noted that the steps of the process 200 discussed below may be performed in any suitable order and are not limited to the order shown in the illustrated embodiment of FIG. 7. Moreover, it should be noted that additional steps of the process 200 may be performed, and certain steps of the process 200 may be omitted. In some embodiments, the process 200 may be executed by the processing circuitry 182 of the controller 180 and/or any other suitable controller of the HVAC system 100. The process 200 may be stored on, for example, the memory 88 or the memory device 184.

The process 200 may begin with receiving a call for cooling or heating, as indicated by block 202. For example, the controller 180 may receive a call (e.g., a control instruction) from the control device 16 or another suitable controller instructing the controller 180 to operate the heat pump 102 in the cooling mode to cool the thermal load 110 or to the heating mode to heat the thermal load 110. In response to receiving the call to operate the heat pump 102 in the cooling mode, the controller 180 may instruct the reversing valve 150 to transition to the first configuration 164 illustrated in FIG. 5. Conversely, in response to receiving the call to operate the heat pump 102 in the heating mode, the controller 180 may instruct the reversing valve 150 to transition to the second configuration 170 illustrated in FIG. 6.

The process 200 includes selecting one of the compressors 132 or a combination of the compressors 132 that enables improved operation of the heat pump 102 in either the heating mode or the cooling mode, as indicated by block 204. For example, in some embodiments, the first compressor 134 may include operational characteristics that enable the first compressor 134 to more efficiently direct refrigerant through the refrigerant circuit 108 during operation of the heat pump 102 in the cooling mode (e.g., as compared to operation of the second compressor 136 to direct refrigerant through the refrigerant circuit 108 in the cooling mode). The second compressor 136 may include operational characteristics that enable the second compressor 136 to more efficiently direct refrigerant through the refrigerant circuit 108 during operation of the heat pump 102 in the heating mode (e.g., as compared to operation of the first compressor 134 to direct refrigerant through the refrigerant circuit 108 in the heating mode). The operational characteristics of the compressors 132 may include respective volume indices or compression ratios of the compressors 132, respective capacities or displacements of the compressors 132 (e.g., a volume of fluid ingested by the compressor 132 per revolution of the compressor 132), and/or other suitable parameters of the compressors 132. As an example, the first compressor 134 may have a first BVR or volume index (e.g., 2.1, 2.2, 2.3, 2.4, 2.5, 2.6), and the second compressor 136 may have a second BVR or volume index (e.g., 3.6 3.7, 3.8, 3.9, 4.0, 4.1, 4.2) that is greater than the first BVR. In certain embodiments, the operational characteristics of the first compressor 134 and/or the second compressor 136 may be selected based on a climatic region (e.g., a geographical location) in which the heat pump 102 is implemented and operated. For clarity, the first compressor 134 may also be referred to herein as a cooling compressor 134, and the second compressor 136 may also be referred to as a heating compressor 136.

The controller 180 may, at block 204, select a particular one or combination of the compressors 132 for operation based on whether a call for cooling or a call for heating is received at the block 202 and based on the operational characteristics of the compressors 132 and/or operational parameters of the HVAC system 100. In particular, the controller 180 may designate a particular one or combination of the compressors 132 for operation in a manner that enhances an overall operational efficiency of the HVAC system 100 while the heat pump 102 operates in either the cooling mode or the heating mode, and may proceed to activate the selected compressors 132 or combination of compressors 132, as indicated by block 206.

For example, in some embodiments, in response to receiving a call for cooling at block 202 (e.g., from the control device 16), the controller 180 may send control signals to transition the reversing valve 150 to the first configuration 164 shown in FIG. 5, to activate the cooling compressor 134, and to transition or retain the heating compressor 136 in an idle (e.g., inactive) state. As such, the cooling compressor 134 may direct refrigerant along the refrigerant circuit 108 (e.g., in the first flow direction 172) to operate the heat pump 102 in the cooling mode, while the heating compressor 136 may be inactive and may not operate to circulate refrigerant along the refrigerant circuit 108. In response to receiving a call for heating at block 202 (e.g., from the control device 16), the controller 180 may send control signals to transition the reversing valve 150 to the second configuration 170 shown in FIG. 6, to activate the heating compressor 136, and to transition or retain the cooling compressor 134 in an idle (e.g., inactive) state. Accordingly, the heating compressor 136 may direct refrigerant along the refrigerant circuit 108 in the second flow direction 174 to operate the heat pump 102 in the heating mode while the cooling compressor 134 may be inactive and may not operate to circulate refrigerant along the refrigerant circuit 108.

Figure 8:
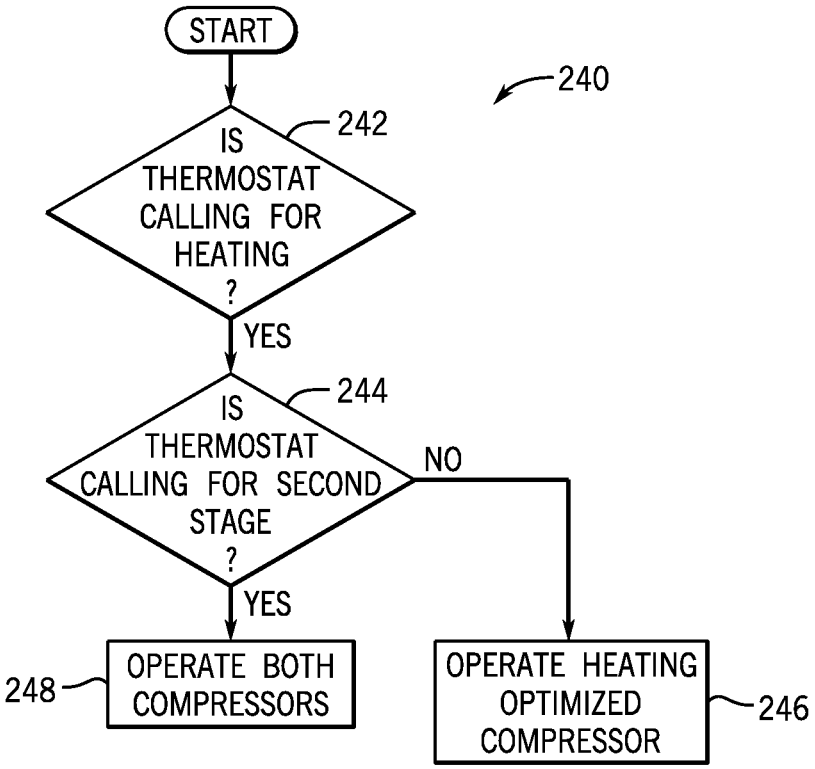
FIG. 8 is a flow diagram of an embodiment of a process for operating a heat pump system, in accordance with an aspect of the present disclosure.

In some embodiments, the controller 180 may operate both the cooling compressor 134 and the heating compressor 136 in conjunction with one another and in a manner that further improves the operational efficiency of the heat pump 102 in the cooling mode or the heating mode (e.g., by reducing electrical resistance heat that may be involved to meet relatively large heating loads). To better illustrate and to facilitate the following discussion, FIG. 8 is flow diagram of an embodiment of a process 240 for controlling one or more of the compressors 132 to enhance an operational efficiency of the heat pump 102 in the heating mode. However, it should be understood that the process 240 may be implemented in a similar manner to improve the operational efficiency of the heat pump 102 in the cooling mode. FIG. 8 will be referred to concurrently with FIGS. 5 and 6 throughout the following discussion. It should be noted that the steps of the process 240 discussed below may be performed in any suitable order and are not limited to the order shown in the illustrated embodiment of FIG. 8. Moreover, it should be noted that additional steps of the process 240 may be performed, and certain steps of the process 240 may be omitted. In some embodiments, the process 240 may be executed by the processing circuitry 182 of the controller 180 and/or any other suitable controller of the HVAC system 100. The process 240 may be stored on, for example, the memory 88 or the memory device 184.

The process 240 includes determining (e.g., via the controller 180) whether there is an outstanding call for heating (e.g., from the control device 16), as indicated by block 242. In response to determining (e.g., based on signals received from the control device 16) that a call for heating exists, the controller 180 may determine, at block 244, whether a call for multi-compressor or increased (e.g., second) stage compressor operation is desired. The controller 180 may determine whether the call for multi-compressor or increased stage compressor operation exists via evaluation of one or more operating parameters of the HVAC system 100, as discussed below.

As an example, in some embodiments, the controller 180 may determine that a call for multi-compressor or increased compressor stage operation exists in response to receiving feedback (e.g., data) from the control device 16 that a temperature of or within the thermal load 110 (e.g., an air temperature in the thermal load 110, a detected temperature, a measured temperature) deviates from a target temperature set point (e.g., st point temperature) for the thermal load 110 by a threshold amount and/or by a threshold percentage (e.g., a threshold value). In other words, in the controller 180 may determine that a call for multi-compressor exists in response to a determination that a temperature differential between the temperature of or within the thermal load 110 and the target temperature set point is equal to or greater than the threshold amount. In some embodiments, the controller 180 may receive data indicative the temperature of or within the thermal load 110 from a sensor, such as a room air sensor or a return air sensor, and the controller 180 may receive data indicative of target temperature set point for the thermal load 110 from the control device 16 (e.g., a thermostat). Based on the data, the controller 180 may determine a temperature differential between the temperature of the thermal load 110 and the set point temperature and may compare the temperature differential to the threshold amount.

The controller 180 may determine that multi-compressor or increased compressor stage operation is desired in response to determining that a heating demand of the thermal load 110 is relatively high, such as when the temperature of or within the thermal load 110 is below the target temperature set point for the thermal load 110 by the threshold amount. Additionally or alternatively, the controller 180 may determine that multi-compressor or increased compressor stage operation is desired based on a time of day at which the call for heating is received at block 242, based on an occupancy within the thermal load 110 at the time the call for heating is received, based on ambient atmospheric conditions surrounding the HVAC system 100 at the time the call for heating is received, based on a suction pressure of the compressor system 130, based on a discharge pressure of the compressor system 130, based on an operational speed of the fans 116 and/or 118, or any combination thereof.

In any case, in response to determining that a call for heating exists at block 242 and that multi-stage compressor operation is not desired at block 244, the controller 180 may send instructions (e.g., control signals) to operate the heating compressor 136 and may transition and/or retain the cooling compressor 134 in an idle state, as indicated by block 246. In response to determining that a call for heating exists at block 242 and that multi-stage compressor operation is desired at block 244, the controller 180 may send instructions to operate both the heating compressor 136 and the cooling compressor 134, as indicated by block 248.

In some embodiments, the controller 180 may determine a demand level of the thermal load 110 at block 244. The controller 180 may, based on the determined demand level of the thermal load 110, determine whether to operate one or multiple of the compressors 132 and, in embodiments where a call for multi-compressor operation is determined, stage sequential operation of the cooling compressor 134, the heating compressor 136, and/or additional compressors 132 that may be included in the compressor system 130 during execution of the block 246. For example, in some embodiments, the controller 180 may determine that a mild heating demand level exists for the thermal load 110 in response to determining that a temperature of or within the thermal load 110 is below a target temperature set point of the thermal load 110 by a first threshold amount or percentage. The controller 180 may determine that a moderate heating demand level exists for the thermal load 110 in response to determining that the temperature of or within the thermal load 110 is below the target temperature set point of the thermal load 110 by a second threshold amount or percentage that is greater than the first threshold amount or percentage. Further, the controller 180 may determine that a high heating demand level exists for the thermal load 110 in response to determining that the temperature of or within the thermal load 110 is below the target temperature set point of the thermal load 110 by a third threshold amount or percentage that is greater than the second threshold amount or percentage In response to determining that a mild heating demand level exists for the thermal load 110 at block 244, the controller 180 may send instructions to activate the cooling compressor 134 and to deactivate the heating compressor 136 (and/or retain the heating compressor 136 in an inactive state). In some embodiments, the cooling compressor 134 may have a capacity (e.g., operating output) that is less than a capacity of the heating compressor 136. However, the relatively low capacity of the cooling compressor 134 may still be sufficient to enable the heat pump 102 to adequately satisfy the mild heating demand of the thermal load 110, while also enabling the heat pump 102 to operate at an improved efficiency level (e.g., using less electrical power), as compared to operating the heating compressor 136 to circulate refrigerant through the refrigerant circuit 108 to satisfy the mild heating demand. For example, during operation to satisfy the mild heating demand, a pressure ratio across the compressor system 130 may be relatively low, and the cooling compressor 134, which may be configured to operate more efficiently at lower pressure ratios than the heating compressor 136, may operate with improved efficiency to satisfy the mild heating demand.

In response to determining that a moderate heating demand level exists for the thermal load 110 at block 244, the controller 180 may send instructions to deactivate the cooling compressor 134 (and/or retain the cooling compressor 134 in an inactive state) and to activate the heating compressor 136, which may operate more efficiently than the cooling compressor 134 at higher pressure ratios associated with the moderate heating demand. As such, the controller 180 may operate the heating compressor 136 in a manner that enables the heat pump 102 to adequately satisfy the moderate heating demand level of the thermal load 110 with improved efficiency. Further, in response to determining that a high heating demand level exists for the thermal load 110 at block 244, the controller 180 may send instructions activate both the cooling compressor 134 and the heating compressor 136 to increase an overall output (e.g., capacity) of the compressor system 130 and enable the heat pump 102 to adequately satisfy the relatively high heating demand level of the thermal load 110.

In embodiments of the compressor system 130 having more than two compressors 132, the controller 180 may selectively activate or deactivate any one or combination of the compressors 132 based on a current (e.g., existing, updated) heating or cooling demand of the thermal load 110 and/or based on one or more measured operational parameters of the HVAC system 100 (e.g., measured ambient or outdoor air temperatures) to enable the heat pump 102 to adequately satisfy the heating or cooling demand of the thermal load 110 with improved efficiency. For example, the controller 180 may be configured to sequentially activate one, two, three, four, five, six, or more than six compressors 132 of the compressor system 130 based on the current heating or cooling demand of the thermal load 110 and/or based on one or more measured operational parameters of the HVAC system 100 to enable the heat pump 102 to adequately satisfy the heating or cooling demand of the thermal load 110 with improved efficiency. In some embodiments, multiple compressors 132 may be sequentially activated based on respective operating efficiencies of the compressors 132 (e.g., a most efficient non-operating compressor 132 is activated before other non-operating compressors 132 are activated). Moreover, in certain embodiments, one or more of the compressors 132 may include multi-stage compressors 132 or variable speed compressors 132. In such embodiments, the controller 180 may be configured to selectively adjust stages of one or more of the compressors 132 and/or speeds of one or more of the compressors 132 in a manner that enables the heat pump 102 to adequately satisfy the cooling or heating demand of the thermal load 110 with improved efficiency. The controller 180 may be configured to adjust operation of the compressors 132 in accordance with the aforementioned techniques based on sensor feedback (e.g., ambient temperature sensor feedback), control instructions received from other control devices of the HVAC system 100, user input provided via a user interface 258 of the HVAC system 100 that is communicatively coupled to the controller 180, and/or based on other suitable control instructions received by the controller 180.

Figure 9:
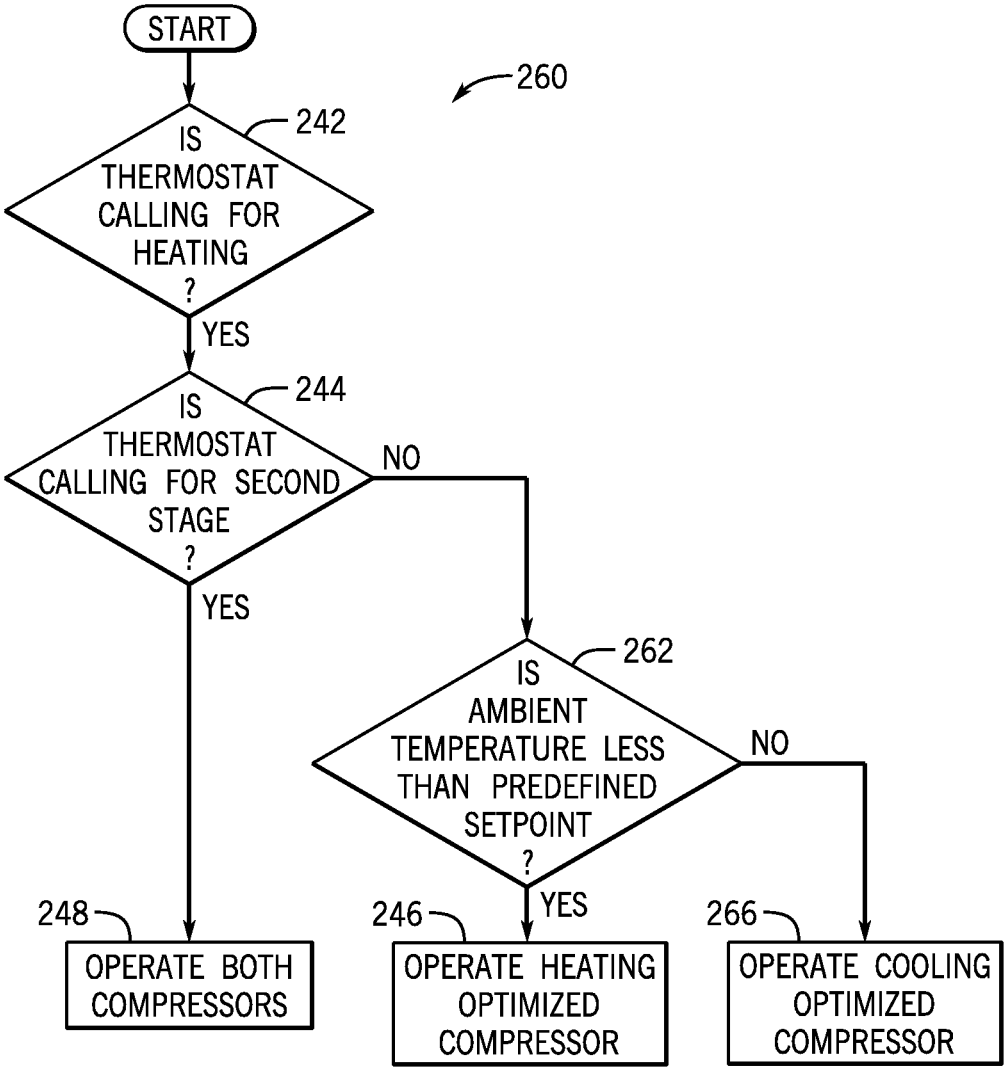
FIG. 9 is a flow diagram of an embodiment of a process for operating a heat pump system, in accordance with an aspect of the present disclosure.

FIG. 9 is flow diagram of another embodiment of the process 240, referred to herein as a process 260. FIGS. 5, 6, and 9 are discussed concurrently below. In the illustrated embodiment of the process 260, in response to determining that a call for heating exists at block 242 and that multi-stage compressor operation is not desired at block 244, the controller 180 may determine whether an ambient temperature of the ambient environment 112 is less than an ambient temperature set point (e.g., set point value, threshold value), as indicated by block 262. For example, in some embodiments, the controller 180 may be communicatively coupled to a temperature sensor 264, as shown in FIG. 5, or a plurality of temperature sensors, configured to measure a temperature of the ambient environment 112. In response to receiving feedback from the temperature sensor 264, the controller 180 may compare the temperature of the ambient environment 112 to the ambient temperature set point (e.g., which may be stored in the memory device 184). The controller 180 may receive the ambient temperature set point via a user input provided via the user interface 258 of the HVAC system 100, for example.

In response to a determination that the ambient temperature is greater than the ambient temperature set point at block 262 (e.g., associated with lower pressure ratios across the compressor system 130), the controller 180 may send instructions to operate the cooling compressor 134 and to deactivate the heating compressor 136 (and/or retain the heating compressor 136 in an inactive state), as indicated by block 266. In some embodiments, while the temperature of the ambient environment 112 is greater than the ambient temperature set point, the cooling compressor 134 may have a capacity (e.g., an operating output) that is sufficient to enable the heat pump 102 to adequately satisfy the heating demand of the thermal load 110, while utilizing a relatively low amount of power (e.g., as compared to an amount of power consumed by the heating compressor 136, which may have a greater capacity than the cooling compressor 134). Conversely, in response to a determination that the ambient temperature is equal to or less than the ambient temperature set point at block 262 (e.g., associated with higher pressure ratios across the compressor system 130), the controller 180 may send instructions to operate the heating compressor 136 and to deactivate the cooling compressor 134 (and/or retain the cooling compressor 134 in an inactive state), as indicated by block 246. Additionally or alternatively, the controller 180 may implement the process 260 to operate more than two compressors 132, to operate one or more multi-stage compressors 132, and/or to operate one or more variable speed compressors 132 in accordance with the aforementioned techniques.

Figure 10:
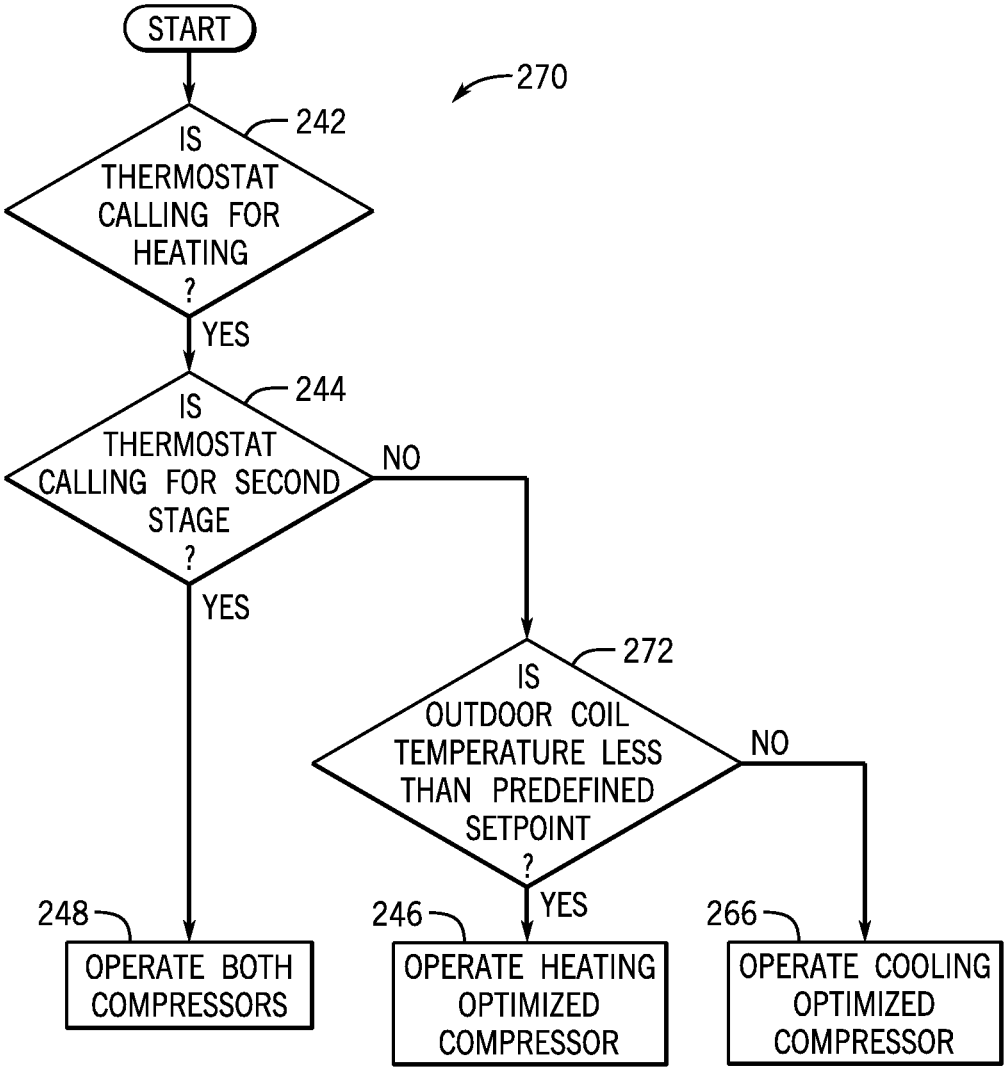
FIG. 10 is a flow diagram of an embodiment of a process for operating a heat pump system, in accordance with an aspect of the present disclosure.

FIG. 10 is flow diagram of another embodiment of the process 240, referred to herein as a process 270. FIGS. 5, 6, and 10 are discussed concurrently below. In the illustrated embodiment of the process 270, in response to determining that a call for heating exists at block 242 and that multi-stage compressor operation is not desired at block 244, the controller 180 may determine whether a coil temperature (e.g., outdoor coil temperature) of the second heat exchanger 106 (e.g., an outdoor heat exchanger or coil) is less than a coil temperature set point (e.g., outdoor coil temperature set point, set point value, threshold value) for the second heat exchanger 106, as indicated by block 272. For example, in some embodiments, the controller 180 may be communicatively coupled to a coil temperature sensor 274, as shown in FIG. 5, such as a temperature probe, that is configured to measure a coil temperature of the second heat exchanger 106. The coil temperature of the second heat exchanger 106 may be indicative of a surface temperature of a portion of the second heat exchanger 106, a temperature of refrigerant entering into or discharging from the second heat exchanger 106, or another suitable (e.g., representative) temperature of the second heat exchanger 106. In response to receiving feedback from the coil temperature sensor 274, the controller 180 may compare the coil temperature of the second heat exchanger 106 to the coil temperature set point (e.g., which may be stored in the memory device 184). The controller 180 may receive the coil temperature set point via a user input provided at the user interface 258, for example.

In response to a determination that the coil temperature of the second heat exchanger 106 is greater than the coil temperature set point at the block 272, the controller 180 may send instructions to operate the cooling compressor 134 and to deactivate the heating compressor 136 (and/or retain the heating compressor 136 in an inactive state), as indicated by block 266. In some embodiments, while the coil temperature of the second heat exchanger 106 is greater than the coil temperature set point, the cooling compressor 134 may have a capacity (e.g., an operating output) that is sufficient to enable the heat pump 102 to adequately satisfy the heating demand of the thermal load 110, while utilizing a relatively low amount of power (e.g., as compared to an amount of power consumed by the heating compressor 136, which may have a greater capacity than the cooling compressor 134). Conversely, in response to a determination that the coil temperature of the second heat exchanger 106 is equal to or less than the coil temperature set point at block 272, the controller 180 may send instructions to operate the heating compressor 136 and to deactivate the cooling compressor 134 (and/or retain the cooling compressor 134 in an inactive state), as indicated by block 246. Additionally or alternatively, the controller 180 may implement the process 270 to operate more than two compressors 132, to operate one or more multi-stage compressors 132, and/or to operate one or more variable speed compressors 132 in accordance with the aforementioned techniques.

Figure 11:
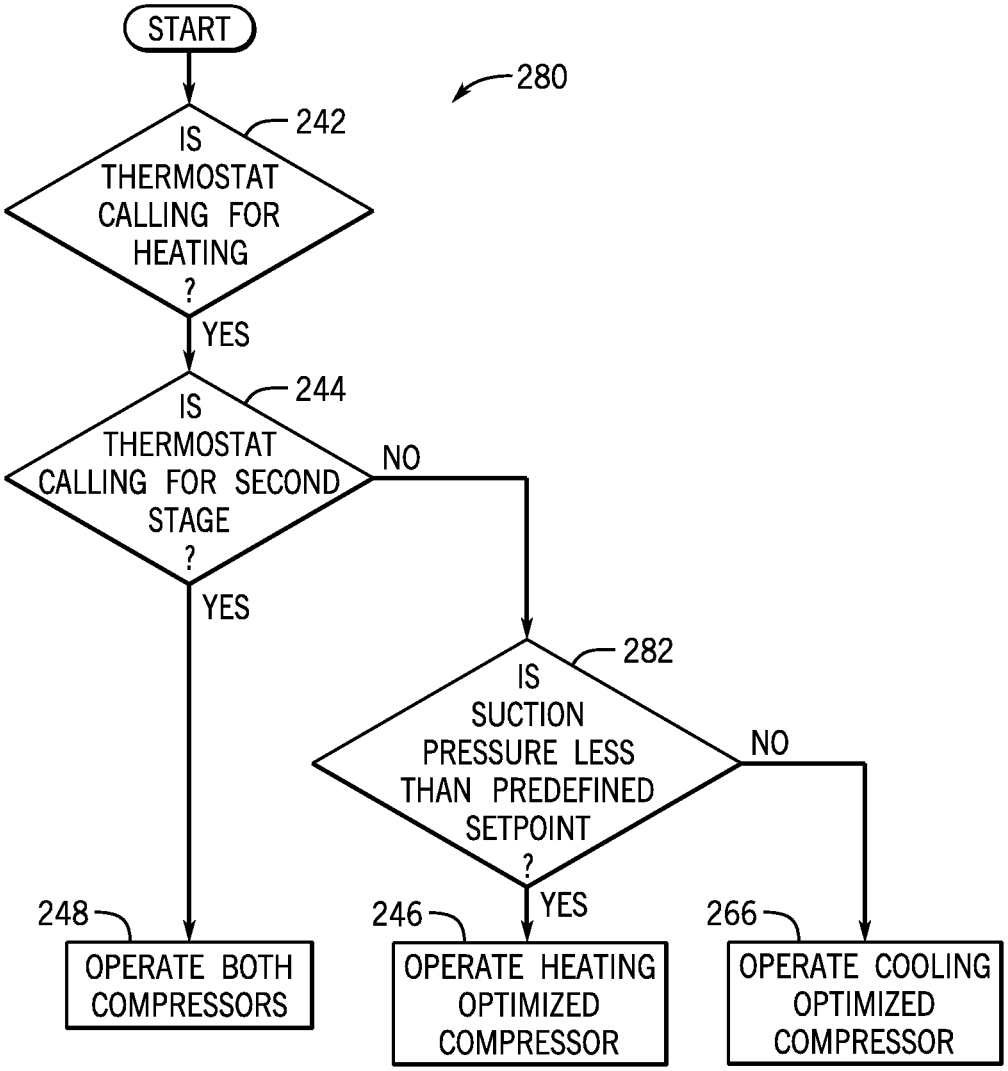
FIG. 11 is a flow diagram of an embodiment of a process for operating a heat pump system, in accordance with an aspect of the present disclosure.

FIG. 11 is flow diagram of another embodiment of the process 240, referred to herein as a process 280. FIGS. 5, 6, and 11 are discussed concurrently below. In the illustrated embodiment of the process 280, in response to determining that a call for heating exists at block 242 and that multi-stage compressor operation is not desired at block 244, the controller 180 may determine whether a compressor suction pressure is less than a suction pressure set point (e.g., set point value, threshold value), as indicated by block 282. For example, in some embodiments, the controller 180 may be communicatively coupled to a pressure sensor 284, as shown in FIG. 5, configured to measure a pressure (e.g., a suction pressure) along a suitable portion of the refrigerant circuit 108 (e.g., along the suction conduit 140) or at a corresponding inlet of one of the compressors 132. In response to receiving feedback from the pressure sensor 284, the controller 180 may compare the suction pressure to the suction pressure set point (e.g., which may be stored in the memory device 184). The controller 180 may receive the suction pressure set point via a user input provided at the user interface 258, for example.

In response to a determination that the suction pressure is greater than the suction pressure set point at block 282, the controller 180 may send instructions to operate the cooling compressor 134 and to deactivate the heating compressor 136 (and/or retain the heating compressor 136 in an inactive state), as indicated by block 266. Conversely, in response to a determination that the suction pressure is equal to or less than the suction pressure set point at block 282, the controller 180 may send instructions to operate the heating compressor 136 and to deactivate the cooling compressor 134 (and/or retain the cooling compressor 134 in an inactive state), as indicated by block 246. Additionally or alternatively, the controller 180 may implement the process 280 to operate more than two compressors 132, to operate one or more multi-stage compressors 132, and/or to operate one or more variable speed compressors 132 in accordance with the aforementioned techniques.

Figure 12:
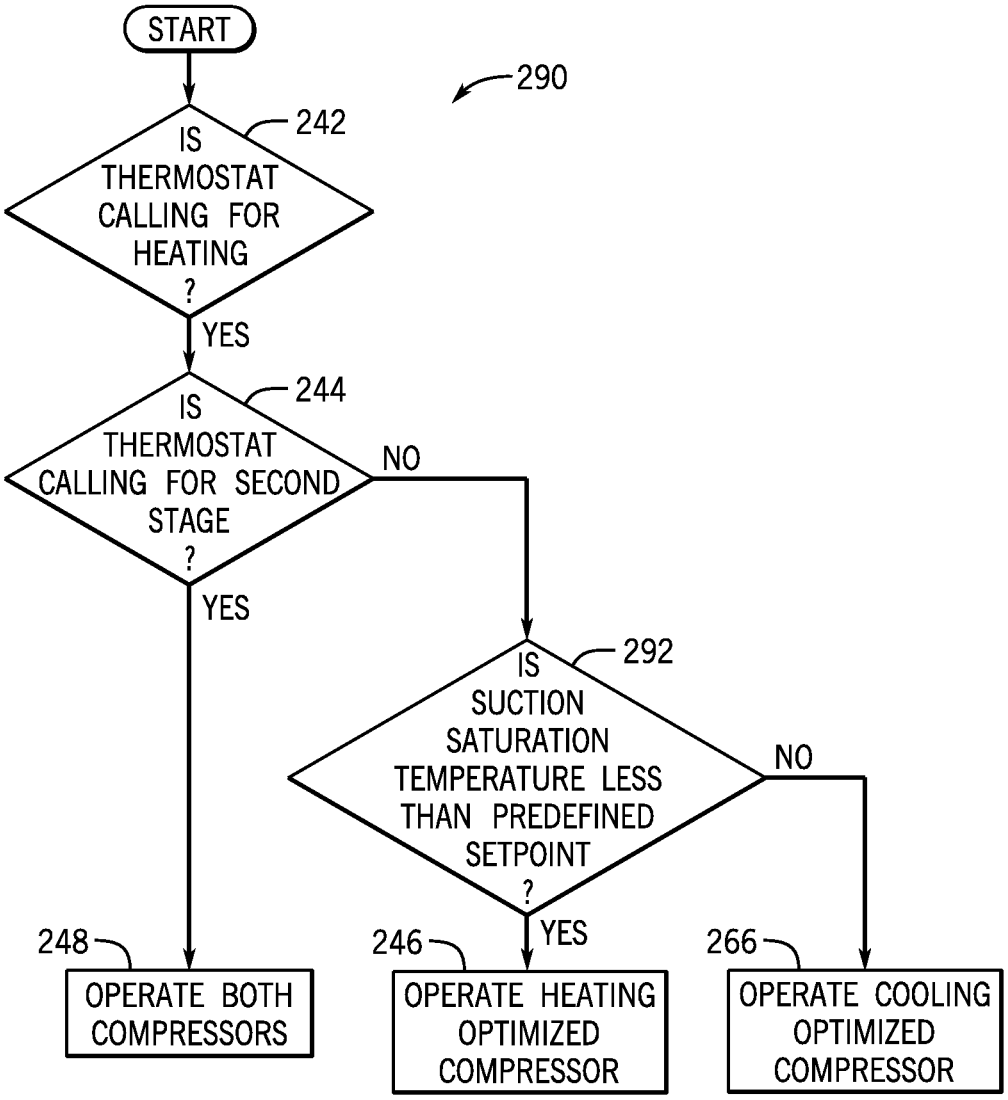
FIG. 12 is a flow diagram of an embodiment of a process for operating a heat pump system, in accordance with an aspect of the present disclosure.

FIG. 12 is flow diagram of another embodiment of the process 240, referred to herein as a process 290. FIGS. 5, 6, and 12 are discussed concurrently below. In the illustrated embodiment of the process 290, in response to determining that a call for heating exists at block 242 and that multi-stage compressor operation is not desired at block 244, the controller 180 may determine whether a suction saturation temperature of refrigerant along a portion of the refrigerant circuit 108 is less than a suction saturation temperature set point (e.g., threshold value, set point value), as indicated by block 292. For example, in some embodiments, the controller 180 may be communicatively coupled to a suction saturation temperature sensor 294, as shown in FIG. 6, configured to measure a suction saturation temperature of refrigerant along a suitable portion of the refrigerant circuit 108. In response to receiving feedback from the suction saturation temperature sensor 294, the controller 180 may compare the suction saturation temperature to the suction saturation temperature set point (e.g., which may be stored in the memory device 184). The controller 180 may receive the suction saturation temperature set point via a user input provided at the user interface 258, for example. It should be appreciated that, additionally or alternatively, the controller 180 may calculate the suction saturation temperature based on a suction pressure measurement (e.g., as determined via feedback provided by a suitable sensor) and thermodynamic property relations of the working fluid (e.g., refrigerant) implemented in the refrigerant circuit 108.

In any case, in response to a determination that the suction saturation temperature is greater than the suction saturation temperature set point at block 292, the controller 180 may send instructions to operate the cooling compressor 134 and to deactivate the heating compressor 136 (and/or retain the heating compressor 136 in an inactive state), as indicated by block 266. Conversely, in response to a determination that the suction saturation temperature is equal to or less than the suction saturation temperature set point at block 292, the controller 180 may send instructions to operate the heating compressor 136 and to deactivate the cooling compressor 134 (and/or retain the cooling compressor 134 in an inactive state), as indicated by block 246. Additionally or alternatively, the controller 180 may implement the process 280 to operate more than two compressors 132, to operate one or more multi-stage compressors 132, and/or to operate one or more variable speed compressors 132 in accordance with the aforementioned techniques.

Figure 13:
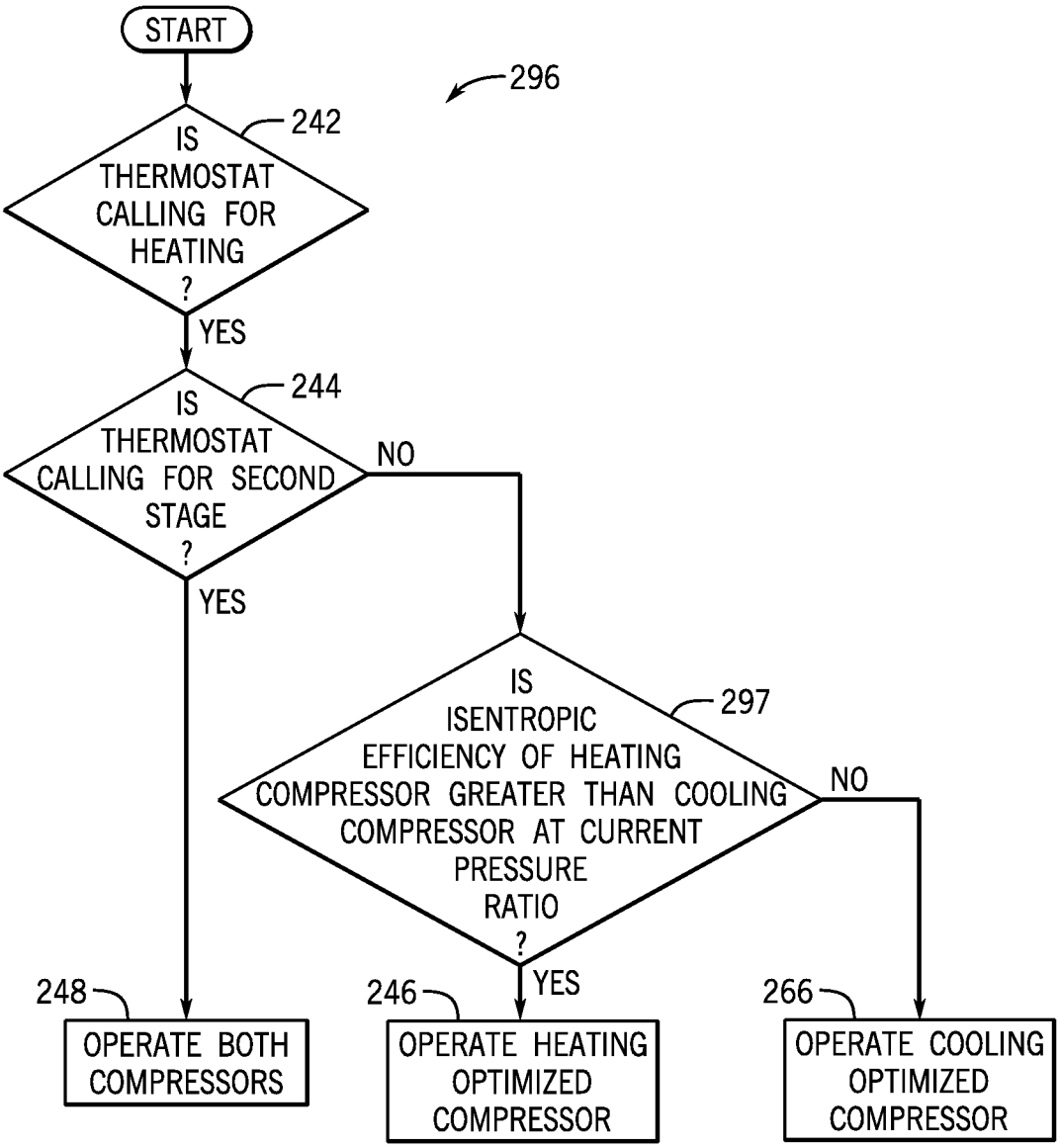
FIG. 13 is a flow diagram of an embodiment of a process for operating a heat pump system, in accordance with an aspect of the present disclosure.

FIG. 13 is flow diagram of another embodiment of the process 240, referred to herein as a process 296. FIGS. 5, 6, and 13 are discussed concurrently below. In the illustrated embodiment of the process 296, in response to determining that a call for heating exists at block 242 and that multi-stage compressor operation is not desired at block 244, the controller 180 may determine whether a current isentropic efficiency of the heating compressor 136 is greater than a current isentropic efficiency of the cooling compressor 134, as indicated by block 297. For example, in some embodiments, the controller 180 may be communicatively coupled to an inlet pressure sensor 298, as shown in FIG. 5, that is disposed along the suction conduit 140 and is configured to measure a common inlet pressure (e.g., of the compressors 132) along the suction conduit 140. Further, the controller 180 may be communicatively coupled to an outlet pressure sensor 299 that is disposed along the discharge conduit 142 and is configured to measure a common outlet pressure (e.g., of the compressors 132) along the discharge conduit 142. The controller 180 may utilize feedback from the inlet and outlet pressure sensors 298, 299 to calculate (e.g., using algorithms and/or lookup tables stored in the memory device 184) a theoretical isentropic efficiency of each of the compressors 132 at the current operational state of the refrigerant circuit 108 (e.g., of the compressors 132). Additionally or alternatively, the controller 180 may calculate or estimate the isentropic efficiency and/or pressure ratios of one or more of the compressors 132 based on sensor feedback indicative of an entering air temperature of the first heat exchanger 104 (e.g., an indoor coil) and an entering air temperature of the second heat exchanger 106 (e.g., an outdoor coil).

In response to a determination that the calculated isentropic efficiency of the heating compressor 136 is less than or equal to the calculated isentropic efficiency of the cooing compressor 134 at block 297, the controller 180 may send instructions to operate the cooling compressor 134 and to deactivate the heating compressor 136 (and/or retain the heating compressor 136 in an inactive state), as indicated by block 266. Conversely, in response to a determination that the calculated isentropic efficiency of the heating compressor 136 is greater than the calculated isentropic efficiency of the cooling compressor 134 at block 297, the controller 180 may send instructions to operate the heating compressor 136 and to deactivate the cooling compressor 134 (and/or retain the cooling compressor 134 in an inactive state), as indicated by block 246. Additionally or alternatively, the controller 180 may implement the process 296 to operate more than two compressors 132, to operate one or more multi-stage compressors 132, and/or to operate one or more variable speed compressors 132 in accordance with the aforementioned techniques.

Figure 14:
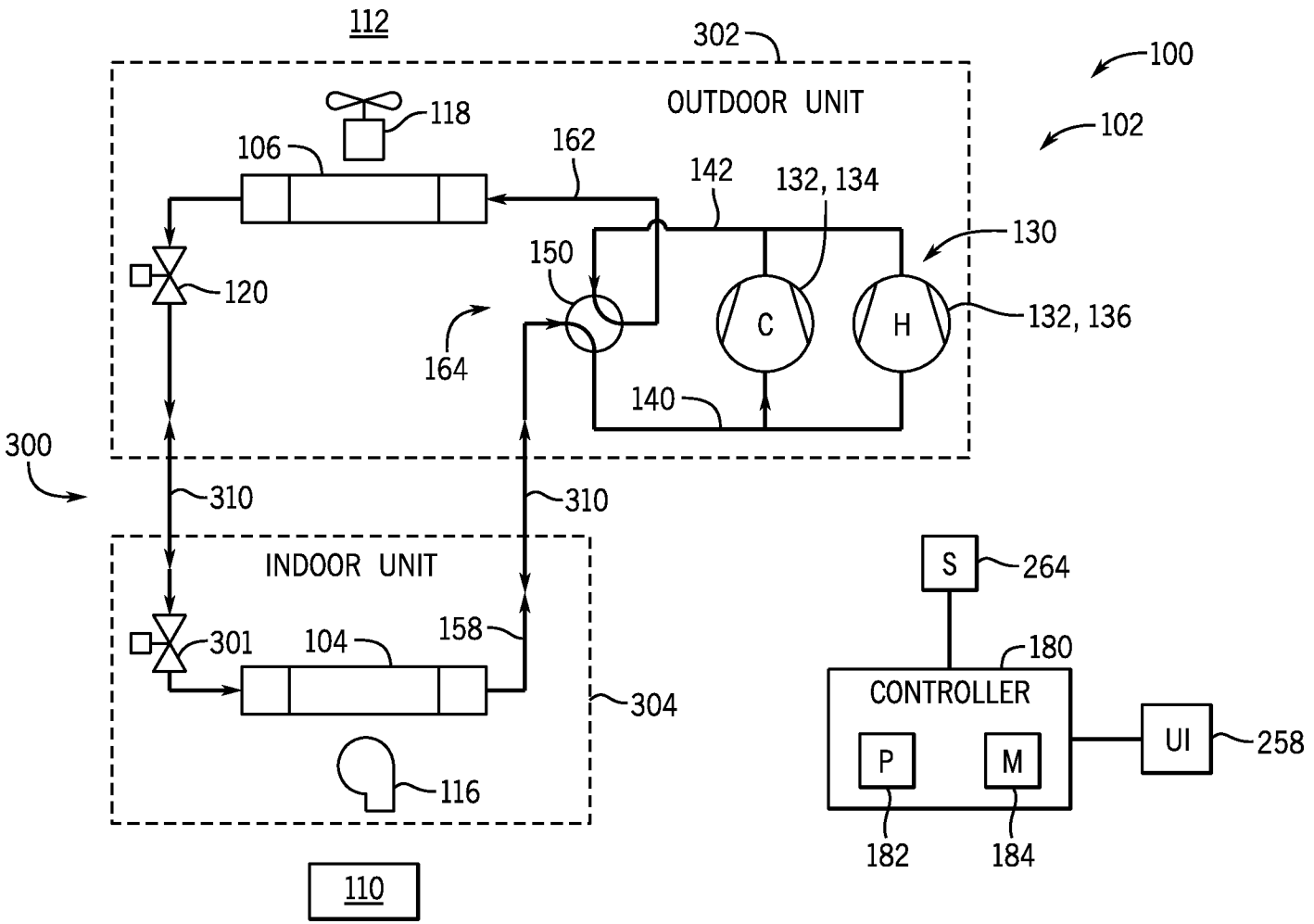
FIG. 14 is a schematic diagram of an embodiment of a portion of an HVAC system that includes a split heat pump system, illustrating the split heat pump system configured for operation in a heating mode, in accordance with an aspect of the present disclosure.

FIG. 14 is a schematic of an embodiment of the HVAC system 100, illustrating the heat pump 102 having a split configuration 300. In the split configuration 300, the heat pump 102 may include an outdoor unit 302 having the compressor system 130, the reversing valve 150, the expansion device 120, the second fan 118, and/or the second heat exchanger 106, for example. Moreover, in the split configuration 300, the heat pump 102 may include an indoor unit 304 (e.g., positioned within a building or conditioned space) having an additional expansion valve 301, the first heat exchanger 104, and the first fan 116, for example. Thus, the outdoor unit 302 and the indoor unit 304 may include portions of the HVAC system 100 that are disposed at different locations with respect to one another. In particular, the outdoor unit 302 may be positioned in the ambient environment 112, while the indoor unit 304 may be positioned within the thermal load 110 and/or adjacent to the thermal load 110 (e.g., a room, an attic, a basement, or area adjacent to the space conditioned by the HVAC system 100).

Figure 15:
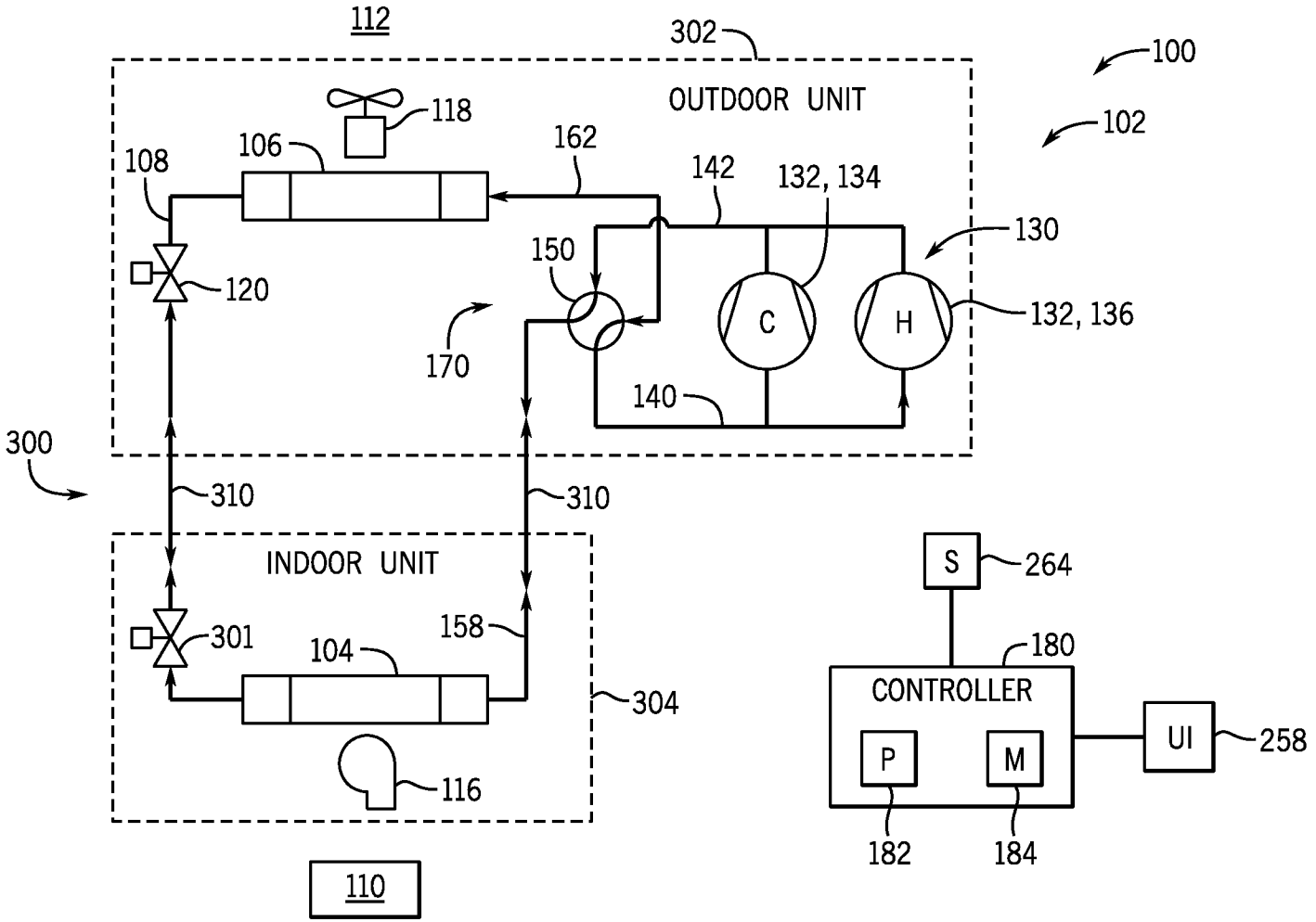
FIG. 15 is a schematic diagram of an embodiment of a portion of an HVAC system that includes a split heat pump system, illustrating the split heat pump system configured for operation in a heating mode, in accordance with an aspect of the present disclosure.

A portion of the refrigerant circuit 108 included in the outdoor unit 302 may be fluidly coupled to a remaining portion of the refrigerant circuit 108 included in the indoor unit 304 via connection portions 310 (e.g., conduits) of the refrigerant circuit 108. In the illustrated embodiment, the reversing valve 150 is positioned in the first configuration 164 to enable operation of the heat pump 102 in the cooling mode. FIG. 15 is a schematic of an embodiment of the heat pump 102 having the split configuration 300, illustrating the reversing valve 150 in the second configuration 170, thereby enabling operation of the heat pump 102 in the heating mode. The embodiments illustrated in FIGS. 14 and 15 may be configured to operate utilizing the techniques discussed in detail above.

Figure 16:
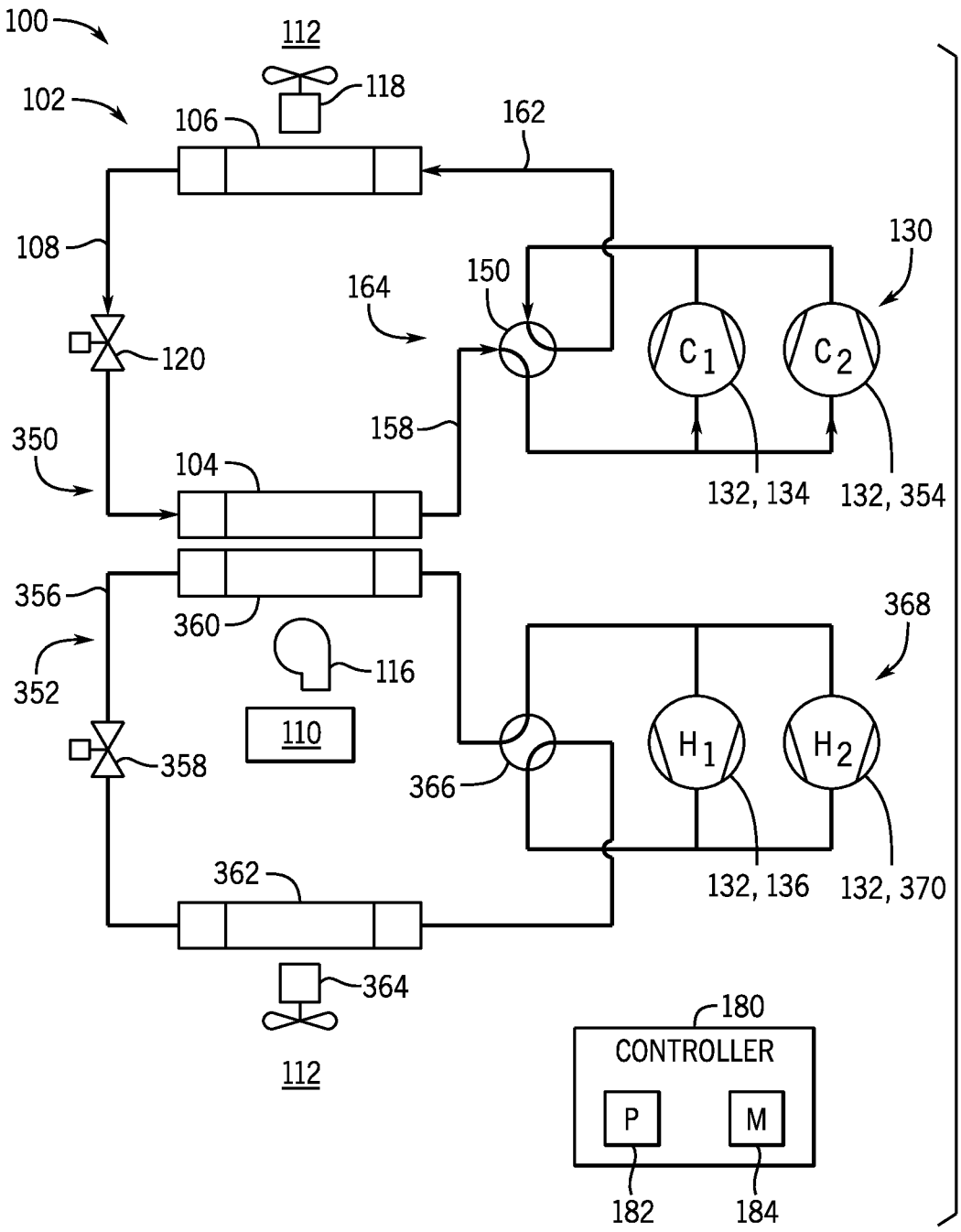
FIG. 16 is a schematic diagram of an embodiment of a portion of an HVAC system that includes a dual heat pump system, in accordance with an aspect of the present disclosure.

FIG. 16 is a schematic of an embodiment of a portion of the HVAC system 100 that includes a dual heat pump system 350 (e.g., a multi-system heat pump, a multi-circuit heat pump). The dual heat pump system 350 includes the heat pump 102 and an additional heat pump 352. The heat pump 102 includes an embodiment of the compressor system 130 (e.g., a first compressor system) having the cooling compressor 134 and an additional cooling compressor 354 that are fluidly coupled to the refrigerant circuit 108 (e.g., relative to a flow of refrigerant through the compressors 134, 354) in a parallel configuration. The cooling compressor 134 and the additional cooling compressor 354 may include operational characteristics (e.g., volume ratio, volume index, volume geometry, built-in volume ratio, etc.) that are tailored (e.g., selected) to enhance operation (e.g., efficiency) of the heat pump 102 in the cooling mode. The additional heat pump 352 includes an additional refrigerant circuit 356 having an additional expansion device 358, a first additional heat exchanger 360, a second additional heat exchanger 362, an additional fan 364, an additional reversing valve 366, and an additional compressor system 368 (e.g., a second compressor system) that includes the heating compressor 136 and an additional heating compressor 370 arranged in a parallel configuration (e.g., relative to a flow of refrigerant through the compressors 136, 370). The heating compressor 136 and the additional heating compressor 370 may include operational characteristics (e.g., volume ratio, volume index, volume geometry, etc.) that are tailored (e.g., selected) to enhance operation of the additional heat pump 352 in a heating mode. The first fan 116 may be configured to draw a fluid flow (e.g., an air flow) across the first heat exchanger 104, the first additional heat exchanger 360, or both, to facilitate thermal regulation of the thermal load 110.

In a cooling mode of the dual heat pump system 350, the heat pump 102 may be operated to cool the thermal load 110 in accordance with the aforementioned techniques, while the additional heat pump 352 (e.g., the additional compressor system 368) may be idle (e.g., inactive). That is, in the cooling mode of the dual heat pump system 350, the reversing valve 150 may be in the first configuration 164 and the cooling compressor 134, the additional cooling compressor 354, or both, may be operational to facilitate cooling of the thermal load 110 via the first heat exchanger 104.

In a first heating mode of the dual heat pump system 350 (e.g., operation of the HVAC system 100 in response to a mild or moderate demand for heating), the heat pump 102 (e.g., the compressor system 130) may be idle (e.g., inactive) and the additional heat pump 352 may be active (e.g., operating) to heat the thermal load 110 using the first additional heat exchanger 360. Particularly, in the moderate heating mode, the heating compressor 136, the additional heating compressor 370, or both, may be operational to facilitate heating of the thermal load 110 via the first additional heat exchanger 360.

In a second heating mode of the dual heat pump system 350 (e.g., operation of the HVAC system 100 in response to a moderate or high demand for heating), both the heat pump 102 and the additional heat pump 352 may be active to facilitate heating of the thermal load 110 via the first heat exchanger 104 and the first additional heat exchanger 360. As such, it should be understood that, in the high heating mode of the dual heat pump system 350, the reversing valve 150 is in the second configuration 170 and the first cooling compressor 134, the additional cooling compressor 354, or both, may be operational to facilitate heating of the thermal load 110 via the first heat exchanger 104, in addition to the heating provided via the first additional heat exchanger 360 of the additional heat pump 352. A portion of or all of the components of the dual heat pump system 350 may be communicatively coupled to the controller 180 to enable the controller 180 to operate (e.g., control) various components of the dual heat pump system 350 in accordance with the presently disclosed techniques. It should be understood that, although the dual heat pump system 350 includes two heat pumps (e.g., the heat pump 102, the additional heat pump 352 in the illustrated embodiment, in other embodiments, the dual heat pump system 350 may include any suitable quantity of individual heat pumps. For example, the dual heat pump system 350 may include a multi-circuit heat pump system having two, three, four, five, six, or more than six separate refrigerant circuits (e.g., heat pumps) that may each be configured for improved operation in cooling modes and heating modes in accordance with the present techniques As set forth above, embodiments of the present disclosure may provide one or more technical effects useful for adjusting operation of a compressor or multiple compressors of a heat pump system based on one or more operational parameters of the heat pump system to adjust compression and/or circulation of refrigerant along a refrigerant circuit of the heat pump in a manner that enhances an overall operational efficiency of the heat pump. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heat pump for a heating, ventilation, and air conditioning (HVAC) system, comprising:

a compressor system configured to direct a refrigerant flow along a refrigerant circuit of the heat pump, wherein the compressor system comprises a first compressor and a second compressor arranged in parallel with one another relative to a direction of the refrigerant flow through the compressor system, the first compressor comprises a first volume index, and the second compressor comprises a second volume index different from the first volume index; and a controller communicatively coupled to the first compressor and the second compressor and configured to selectively operate the first compressor, the second compressor, or both based on an operating mode of the heat pump, wherein the controller is configured to operate the first compressor and the second compressor in response to a determination that a temperature differential between a temperature within a space conditioned by the heat pump and a set point temperature of the space is greater than a threshold amount.

2. The heat pump of claim 1, wherein the heat pump is a reverse-cycle heat pump.

3. The heat pump of claim 1, wherein the second volume index is greater than the first volume index.

4. The heat pump of claim 3, wherein, in a cooling operating mode of the heat pump, the controller is configured to operate the first compressor and to suspend operation of the second compressor.

5. The heat pump of claim 3, wherein, in a heating operating mode of the heat pump, the controller is configured to operate the second compressor and to suspend operation of the first compressor.

6. The heat pump of claim 3, wherein, in response to a determination that the temperature differential between the temperature within the space conditioned by the heat pump and the set point temperature of the space is less than the threshold amount, the controller is configured to:

receive data indicative of an ambient temperature;

compare the ambient temperature to an ambient temperature set point; and operate the first compressor and suspend operation of the second compressor in response to a determination that the ambient temperature is greater than the ambient temperature set point.

7. The heat pump of claim 6, wherein the controller is configured to operate the second compressor and suspend operation of the first compressor in response to a determination that the ambient temperature is equal to or less than the ambient temperature set point.

8. The heat pump of claim 3, wherein, in response to a determination that the temperature differential between the temperature within the space conditioned by the heat pump and the set point temperature of the space is less than the threshold amount, the controller is configured to:

receive data indicative of an outdoor coil temperature;

compare the outdoor coil temperature to an outdoor coil temperature set point; and operate the first compressor and suspend operation of the second compressor in response to a determination that the outdoor coil temperature is greater than the outdoor coil temperature set point.

9. The heat pump of claim 8, wherein the controller is configured to operate the second compressor and suspend operation of the first compressor in response to a determination that the outdoor coil temperature is equal to or less than the outdoor coil temperature set point.

10. The heat pump of claim 1, wherein the first compressor or the second compressor is a fixed speed compressor, a multi-stage compressor, or a variable speed compressor.

11. A heat pump for a heating, ventilation, and air conditioning (HVAC) system, comprising:

a first compressor configured to direct refrigerant flow along a refrigerant circuit of the heat pump, wherein the first compressor comprises a first built-in volume ratio;

a second compressor configured to direct refrigerant flow along the refrigerant circuit of the heat pump, wherein the second compressor comprises a second built-in volume ratio; and a controller communicatively coupled to the first compressor and the second compressor and configured to selectively operate the first compressor, the second compressor, or both based on an operating mode of the heat pump, wherein the controller is configured to operate the first compressor and suspend operation of the second compressor in a cooling mode of the heat pump and configured to operate the second compressor and suspend operation of the first compressor in a heating mode of the heat pump, wherein the first compressor and the second compressor are arranged in parallel with one another relative to a direction of refrigerant flow through the refrigerant circuit, and the second built-in volume ratio is greater than the first built-in volume ratio.

12. The heat pump of claim 11, comprising a reversing valve, wherein the reversing valve is adjustable between a first position and a second position, the reversing valve is configured to direct refrigerant flow to an outdoor heat exchanger of the refrigerant circuit in the first position and in the cooling mode of the heat pump, and the reversing valve is configured to direct refrigerant flow to an indoor heat exchanger of the refrigerant circuit in the second position and in the heating mode of the heat pump.

13. The heat pump of claim 12, comprising the outdoor heat exchanger and the indoor heat exchanger, wherein the first compressor, the second compressor, the reversing valve, and the outdoor heat exchanger are packaged within an outdoor unit of the heat pump, and the indoor heat exchanger is packaged within an indoor unit of the heat pump.

14. The heat pump of claim 11, wherein the controller is configured to:

operate the first compressor and suspend operation of the second compressor in response to a determination that a set point temperature of a conditioned space is less than a detected temperature of the conditioned space; and operate the second compressor and suspend operation of the first compressor in response to a determination that the set point temperature of the conditioned space is greater than the detected temperature of the conditioned space.

15. The heat pump of claim 14, wherein the controller is configured to:

operate the second compressor and suspend operation of the first compressor in response to a determination that the set point temperature of the conditioned space is greater than the detected temperature of the conditioned space by a first temperature differential less than a threshold amount; and operate the second compressor and the first compressor in response to a determination that the set point temperature of the conditioned space is greater than the detected temperature of the conditioned space by a second temperature differential greater than the threshold amount.

16. The heat pump of claim 11, wherein the first compressor or the second compressor is a fixed speed compressor, a multi-stage compressor, or a variable speed compressor.

17. A heat pump for a heating, ventilation, and air conditioning (HVAC) system, comprising:

a refrigerant circuit;

a compressor system disposed along the refrigerant circuit and configured to direct a refrigerant along the refrigerant circuit, wherein the compressor system comprises a first compressor and a second compressor arranged in parallel with one another relative to a flow direction of the refrigerant through the compressor system, the first compressor comprises a first volume index, and the second compressor comprises a second volume index greater than the first volume index;

a first heat exchanger disposed along the refrigerant circuit and configured to place the refrigerant in a heat exchange relationship with a supply air flow;

a second heat exchanger disposed along the refrigerant circuit and configured to place the refrigerant in a heat exchange relationship with an ambient air flow;

a reversing valve configured to direct the refrigerant from the compressor system to the second heat exchanger in a cooling mode of the heat pump and configured to direct the refrigerant from the compressor system to the first heat exchanger in a heating mode of the heat pump; and a controller communicatively coupled to the first compressor and the second compressor and configured to operate the first compressor and suspend operation of the second compressor in the cooling mode.

18. The heat pump of claim 17, wherein the controller is configured to operate the second compressor and suspend operation of the first compressor in the heating mode.

19. The heat pump of claim 17, wherein the controller is configured to:

operate in the heating mode in response to a determination that a temperature of a conditioned space is less than a set point temperature of the conditioned space;

operate the first compressor and the second compressor in response to a determination that a temperature differential between the temperature of the conditioned space and the set point temperature is greater than or equal to a threshold amount; and operate the first compressor or the second compressor in response to a determination that the temperature differential between the temperature of the conditioned space and the set point temperature is less than the threshold amount.

20. The heat pump of claim 19, wherein the controller is configured to:

operate the first compressor and suspend operation of the second compressor in response to the determination that the temperature differential between the temperature of the conditioned space and the set point temperature is less than the threshold amount and in response to a determination that an operating parameter of the heat pump is greater than or equal to a set point value; and operate the second compressor and suspend operation of the first compressor in response to the determination that the temperature differential between the temperature of the conditioned space and the set point temperature is less than the threshold amount and in response to a determination that the operating parameter of the heat pump is less than the set point value, wherein the operating parameter of the heat pump is an ambient temperature, a temperature of the second heat exchanger, a suction pressure of the refrigerant, or a suction saturation temperature of the refrigerant.

* * * * *